US009933192B2

(12) United States Patent
Yamashita

(10) Patent No.: US 9,933,192 B2
(45) Date of Patent: Apr. 3, 2018

(54) AIR-CONDITIONING APPARATUS

(71) Applicant: Koji Yamashita, Tokyo (JP)

(72) Inventor: Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 362 days.

(21) Appl. No.: 14/648,381

(22) PCT Filed: Dec. 20, 2012

(86) PCT No.: PCT/JP2012/083026

§ 371 (c)(1),
(2) Date: May 29, 2015

(87) PCT Pub. No.: WO2014/097440

PCT Pub. Date: Jun. 26, 2014

(65) Prior Publication Data

US 2015/0300709 A1 Oct. 22, 2015

(51) Int. Cl.
*F25B 41/00* (2006.01)
*F25B 13/00* (2006.01)
(Continued)

(52) U.S. Cl.
CPC ..... *F25B 41/00* (2013.01); *F24F 3/065* (2013.01); *F25B 13/00* (2013.01); *F25B 25/005* (2013.01);
(Continued)

(58) Field of Classification Search
CPC ..... F25B 25/005; F25B 13/00; F25B 2313/0231; F25B 2313/0272; F25B 2313/02743; F25B 2313/004; F24F 3/065
See application file for complete search history.

(56) References Cited

U.S. PATENT DOCUMENTS 9,816,736 B2 * 11/2017 Yamashita ..... F25B 29/003
2010/0218549 A1 9/2010 Suzuki et al.
(Continued)

FOREIGN PATENT DOCUMENTS

EP 2 363 663 A1 9/2011
EP 2 363 664 A1 9/2011
(Continued)

OTHER PUBLICATIONS

Japanese Office Action dated May 24, 2016 in the corresponding JP application No. 2014-552829. ( English translation attached.).
(Continued)

*Primary Examiner* — Kun Kai Ma
(74) *Attorney, Agent, or Firm* — Posz Law Group, PLC

(57) ABSTRACT

An air-conditioning apparatus includes a plurality of indoor units each located inside a building and at a position that enables the indoor unit to condition air, and a relay unit installed in a space not to be air-conditioned inside the building. The relay unit and each indoor unit are connected to each other via a first heat medium pipe in which a first heat medium such as water or brine flows. The relay unit accommodates therein a first refrigerant circuit including a compressor, a plurality of first intermediate heat exchangers that exchange heat between the first heat medium and refrigerant that performs a phase shift or turns to a super-critical state during operation, a plurality of expansion devices, and a second intermediate heat exchanger that exchanges heat between the refrigerant and a second heat medium, which are connected via a refrigerant pipe.

10 Claims, 14 Drawing Sheets

(51) Int. Cl.
*F24F 3/06* (2006.01)
*F25B 25/00* (2006.01)

(52) U.S. Cl.
CPC . *F25B 2313/004* (2013.01); *F25B 2313/0231* (2013.01); *F25B 2313/0272* (2013.01); *F25B 2313/02743* (2013.01)

(56) References Cited

U.S. PATENT DOCUMENTS

2010/0326129 A1* 12/2010 Moriwaki ..... C09K 5/045 62/498
2011/0197608 A1* 8/2011 Yamashita ..... F24F 3/06 62/190
2012/0031605 A1* 2/2012 Takayama ..... F24F 11/008 165/201
2012/0180510 A1* 7/2012 Okazaki ..... F25B 13/00 62/218
2012/0192588 A1* 8/2012 Yamashita ..... F25B 13/00 62/498
2012/0198874 A1* 8/2012 Yamashita ..... F24F 3/06 62/160
2012/0222440 A1* 9/2012 Matsui ..... F25B 7/00 62/159
2012/0255316 A1* 10/2012 Andre ..... C09K 5/044 62/98
2012/0291472 A1* 11/2012 Morimoto ..... F24F 1/26 62/324.6
2012/0292006 A1* 11/2012 Yamashita ..... F24F 3/06 165/200
2012/0297803 A1* 11/2012 Yamashita ..... F25B 13/00 62/203
2013/0133361 A1* 5/2013 Yamashita ..... F25B 5/00 62/502
2013/0152613 A1* 6/2013 Yamashita ..... F25B 9/006 62/129
2013/0192283 A1* 8/2013 Yamashita ..... F24F 1/32 62/126
2013/0205824 A1* 8/2013 Morimoto ..... F25B 7/00 62/324.6
2013/0227977 A1* 9/2013 Morimoto ..... F25B 13/00 62/126
2014/0026605 A1* 1/2014 Ishimura ..... F25B 1/00 62/222
2014/0137589 A1* 5/2014 Motomura ..... F25B 13/00 62/238.7
2014/0150483 A1* 6/2014 Takayama ..... F25B 13/00 62/160
2014/0196483 A1* 7/2014 Okazaki ..... F25B 49/02 62/79
2015/0075199 A1* 3/2015 Kotani ..... F25B 7/00 62/238.7
2015/0285545 A1* 10/2015 Yamashita ..... F25B 7/00 62/196.1
2015/0330674 A1* 11/2015 Yamashita ..... F25B 13/00 62/160

FOREIGN PATENT DOCUMENTS

JP H03-213928 A 9/1991
JP H05-280818 A 10/1993
JP H06-082110 A 3/1994
JP 06-337138 A 12/1994
JP H08-338667 A 12/1996
JP 2000-257800 A 9/2000
JP 2001-289465 A 10/2001
JP 2003-343936 A 12/2003
JP 2005-140444 A 6/2005
JP 2006-242441 A 9/2006
JP 2008-101895 A 5/2008
JP 2009-085474 A 4/2009
WO 2010/049998 A1 5/2010
WO 2012/042573 A1 4/2012
WO WO 2012077156 A1 * 6/2012 ..... F25B 7/00

OTHER PUBLICATIONS

International Search Report of the International Searching Authority dated Mar. 5, 2013 for the corresponding international application No. PCT/JP2012/083026 (and English translation).
Extended European Search Report dated Jul. 14, 2016 in the corresponding EP application No. 12890545.2.
Office Action dated Oct. 6, 2015 in the corresponding JP application No. 2014-552829 (with English translation).

* cited by examiner

AIR-CONDITIONING APPARATUS

CROSS REFERENCE TO RELATED APPLICATION

This application is a U.S. national stage application of International Application No. PCT/JP2012/083026 filed on Dec. 20, 2012, the disclosure of which is incorporated by reference.

TECHNICAL FIELD

The present invention relates to an air-conditioning apparatus to be used as, for example, a multi-air-conditioning apparatus for building.

BACKGROUND ART

Some air-conditioning apparatuses such as multi-air-conditioning apparatuses for building are configured to circulate refrigerant, for example between an outdoor unit installed outdoors and indoor units located inside the rooms, to perform a cooling operation or heating operation. More specifically, the refrigerant transfers heat to air so as to heat the air or removes heat from the air so as to cool the air, and such heated or cooled air is utilized to heat or cool the space to be air-conditioned. In such a type of air-conditioning apparatus, for example hydrofluorocarbon (HFC)-based refrigerant is often employed. In addition, air-conditioning apparatuses that employ a natural refrigerant such as carbon dioxide ($CO_2$) have also been proposed.

Further, air-conditioning apparatuses differently configured, typically represented by a chiller system, have been developed. In this type of air-conditioning apparatus, cooling energy or heating energy is generated in the outdoor unit installed outdoors, and a heat medium such as water or antifreeze solution is heated or cooled with a heat exchanger provided in the outdoor unit. Then the heat medium is transported to the indoor unit located in the region to be air-conditioned, such as a fan coil unit or a panel heater, so as to cool or heat the region to be air-conditioned (see, for example, Patent Literature 1).

In addition, an outdoor-side heat exchanger, called exhaust heat collection chiller, is known in which the outdoor unit and the indoor units are connected via four water pipes, and cooled or heated water is supplied at the same time so as to allow each of the indoor units to select cooling or heating operation as desired (see, for example, Patent Literature 2).

Further, an air-conditioning apparatus is known in which a heat exchanger for heat exchange between the refrigerant and the heat medium is located in the vicinity of each indoor unit, and the heat medium is supplied from the heat exchanger to the indoor unit (see, for example, Patent Literature 3).

Further, an air-conditioning apparatus is known in which the outdoor unit and branch units each including a heat exchanger are connected via two pipes, so as to supply the heat medium to the indoor unit (see, for example, Patent Literature 4).

Still further, an air-conditioning apparatus is known in which the outdoor unit and a relay unit are connected via two refrigerant pipes, and the relay unit and the indoor units are connected via two pipes through which a heat medium such as water circulates, so as to transfer heat from the refrigerant to the heat medium in the relay unit, thereby allowing the cooling and heating operation to be performed at the same time (see, for example, Patent Literature 5).

CITATION LIST

Patent Literature

Patent Literature 1: Japanese Unexamined Patent Application Publication No. 2005-140444 (page 4, FIG. 1)

Patent Literature 2: Japanese Unexamined Patent Application Publication No. 5-280818 (pages 4, 5, FIG. 1)

Patent Literature 3: Japanese Unexamined Patent Application Publication No. 2001-289465 (pages 5 to 8, FIGS. 1, 2)

Patent Literature 4: Japanese Unexamined Patent Application Publication No. 2003-343936 (page 5, FIG. 1)

Patent Literature 5: International Publication No. 2010/049998 (page 6, FIG. 1)

SUMMARY OF INVENTION

Technical Problem

In the conventional air-conditioning apparatuses such as the multi-air-conditioning apparatus for building, the refrigerant is made to circulate as far as the indoor units, and hence the refrigerant may leak into the room. Besides, an enormous amount of refrigerant is employed. On the other hand, in the air-conditioning apparatus according to Patent Literature 1 and Patent Literature 2, the refrigerant is kept from passing through the indoor unit. However, although the air-conditioning apparatus according to Patent Literature 1 eliminates the likelihood that the refrigerant leaks into the room, the operation is switchable to only either of cooling and heating, and therefore simultaneous cooling and heating operation is unable to be performed, to satisfy different air-conditioning loads for each of the rooms.

To allow each of the indoor units to select between the cooling and heating operation with the air-conditioning apparatus according to Patent Literature 2, four pipes have to be connected between the outdoor unit and each of the rooms, which makes the installation work complicated. With the air-conditioning apparatus according to Patent Literature 3, each of the indoor units has to have a secondary medium circulation device such as pumps, which leads to an increase not only in cost but also in operation noise, and is hence unsuitable for practical use. In addition, since the heat exchanger is located in the vicinity of the indoor unit, the risk of leakage of the refrigerant into the room or thereabout is unable to be eliminated.

With the air-conditioning apparatus according to Patent Literature 4, the refrigerant which has undergone the heat exchange flows into the same flow path as that of the refrigerant yet to perform the heat exchange and hence energy loss is inevitable, and therefore each of a plurality of indoor units connected in the system is unable to make optimal performance. In addition, the branch unit and an extension pipe are connected via two pipes each for cooling and heating, totally four pipes, which is similar to the system in which the outdoor unit and the branch units are connected via four pipes, and therefore the installation work is complicated.

In the air-conditioning apparatus according to Patent Literature 5, the refrigerant is transported from the outdoor unit to the relay unit through two refrigerant pipes, and then from the relay unit to each indoor unit through two heat medium pipes, so as to allow the cooling and heating operation to be performed at the same time. However, in the case where a flammable refrigerant is employed, since the relay unit is installed inside the building, the refrigerant may ignite inside the building depending on the location of the relay unit. In the case where low-density refrigerant such as HFO-1234yf is employed, a refrigerant pipe (extension pipe) having a large diameter has to be employed between the outdoor unit and the relay unit in order to suppress pressure loss in the refrigerant pipe (extension pipe), which leads to degraded workability for installation. Besides, since the refrigerant has to be circulated between the outdoor unit and the relay unit, a larger amount of refrigerant has to be employed when a longer refrigerant pipe is used to connect between the outdoor unit and the relay unit.

The present invention has been accomplished in view of the foregoing problems, and provides an air-conditioning apparatus that can be efficiently installed. The present invention also provides an air-conditioning apparatus that enables the cooling and heating operation to be performed at the same time with two pipes, without introducing the refrigerant pipe into the building for higher safety. Further, the present invention provides an air-conditioning apparatus that eliminates the need to employ a long refrigerant pipe to connect between outside and inside of the building, to thereby reduce the amount of the refrigerant to be employed.

Solution to Problem

In an aspect, the present invention provides an air-conditioning apparatus including a plurality of indoor units each located inside a building and at a position that allows the indoor unit to condition air in a space to be air-conditioned, and a relay unit configured to be installed in a space not to be air-conditioned separated from the space to be air-conditioned, the space not to be air-conditioned being one of a space inside the building, a recessed space formed in the building and communicating with outside of the building, and a space outside and close to the building. The relay unit and each of the indoor units are connected to each other via a first heat medium pipe in which a first heat medium flows, the first heat medium being water, brine, or the like. The relay unit accommodates therein a refrigerant circuit including a compressor, a plurality of first intermediate heat exchangers that exchange heat between the first heat medium and refrigerant that performs a phase shift or turns to a supercritical state during operation, a plurality of expansion devices, and a second intermediate heat exchanger that exchanges heat between the refrigerant and a second heat medium being air, water, brine, or the like, the compressor, the first intermediate heat exchangers, the expansion devices, and the second intermediate heat exchanger being connected via a refrigerant pipe, and the relay unit is configured to cool the first heat medium and heat the first heat medium simultaneously, separately transport the cooled first heat medium and the heated first heat medium to the plurality of indoor units, and cause the second heat medium to circulate between the outside of the building and the relay unit and exchange heat with the refrigerant in the second intermediate heat exchanger. The air-conditioning apparatus thus configured enables cooling and heating operation to be performed simultaneously with the two heat medium pipes without introducing the refrigerant pipe into the building from outside, thereby providing higher safety and improved workability for installation.

Advantageous Effects of Invention

The air-conditioning apparatus according to the present invention enables a cooling and a heating operation to be performed at the same time with the two heat medium pipes without introducing the refrigerant pipe into the building from outside. The outdoor unit can be installed outdoors or in a machine room, and the relay unit can be installed in the space not to be air-conditioned inside the building, the recessed space formed in the building and communicating with outside of the building, or the space outside and close to the building. Accordingly, the refrigerant is kept from leaking into the room and the amount of the refrigerant in the relay unit is relatively small and therefore, even though a flammable refrigerant leaks out of the relay unit during the operation, the refrigerant does not concentrate enough to ignite. Consequently, higher safety can be attained.

DESCRIPTION OF EMBODIMENTS

Embodiment 1

Figure 1:
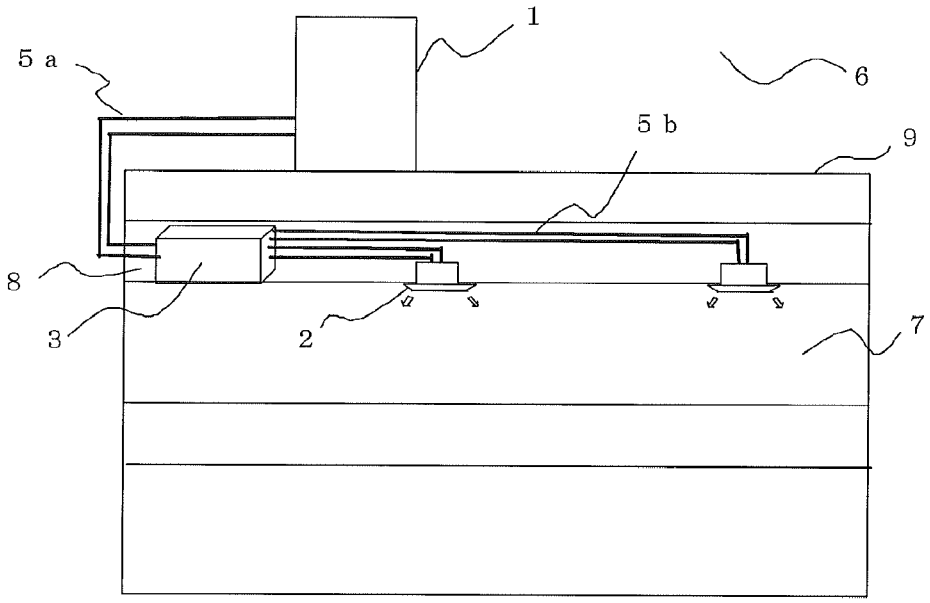
FIG. 1 is a schematic drawing showing an installation example of an air-conditioning apparatus according to Embodiment 1 of the present invention.

Embodiment 1 of the present invention will be described with reference to the drawings. FIG. 1 is a schematic drawing showing an installation example of an air-conditioning apparatus according to Embodiment 1 of the present invention. Referring to FIG. 1, the installation example of the air-conditioning apparatus will be described hereunder. The air-conditioning apparatus is configured to allow selection of an operation mode either a cooling mode or a heating mode with respect to each indoor unit, by utilizing a heat medium circuit (second heat medium circuit B) in which a second heat medium circulates, a refrigerant circuit (first refrigerant circuit C) in which a first refrigerant circulates, and a heat medium circuit (first heat medium circuit D) in which a first heat medium circulates. In FIG. 1 and other drawings, the relative size among the constituents may be different from the actual one. In addition, the expressions "high" or "low" accompanying a temperature or a pressure are not used with respect to a fixed absolute value, but relatively defined depending on the status and conditions of the system and the devices.

As shown in FIG. 1, the air-conditioning apparatus according to Embodiment 1 includes one outdoor unit 1 which is an outdoor unit, a plurality of indoor units 2, and a relay unit 3 installed between the outdoor unit 1 and the indoor units 2. The outdoor unit 1, which serves as a heat removing and heat transferring unit, transfers heat to or removes heat from an outdoor space, to thereby cool or heat the second heat medium. The relay unit 3 utilizes the first refrigerant to transfer heat to or remove heat from the second heat medium, to thereby cool or heat the first heat medium. The first heat medium is distributed to the indoor units 2 to satisfy an air-conditioning load. The outdoor unit 1 and the relay unit 3 are connected to each other via a heat medium pipe 5*a* in which the second heat medium flows. The relay unit 3 and each of the indoor units 2 are connected to each other via a heat medium pipe 5*b* in which the first heat medium flows. Cooling energy or heating energy generated in the relay unit 3 is subjected to heat removal or heat transfer in the outdoor unit 1 via the second heat medium, and distributed to the indoor units 2 via the first heat medium. In Embodiment 1, the first refrigerant has a nature of shifting between two phases or turning to a supercritical state during operation, and the first heat medium and the second heat medium are water, an antifreeze solution, or the like.

The outdoor unit 1 is normally installed in an outdoor space 6 outside (e.g., roof) of an architectural structure, for example a building 9, or in a space inside the building 9 but communicating with the outdoor space 6, and serves to remove or transfer cooling energy or heating energy generated in the relay unit 3, through the second heat medium. The indoor units 2 are each located inside the building 9 at a position that allows cooling air or heating air to be supplied into an indoor space 7, for example a living room, thus to supply the cooling air or heating air into the indoor space 7. The relay unit 3 is provided in a separate casing from those of the outdoor unit 1 and the indoor units 2, so as to be installed in a space not to be air-conditioned 8 (hereinafter, simply space 8) inside the building 9, at a position separated from the outdoor space 6 and the indoor space 7. The relay unit 3 is connected to the outdoor unit 1 and the indoor units 2 via the heat medium pipe 5*a* and the heat medium pipe 5*b* respectively, to serve to transfer the generated cooling energy or heating energy to the indoor units 2.

The relay unit 3 may be separately located from the outdoor unit 1 and the indoor units 2, and may be enclosed in a single casing or a plurality of casings, provided that the casing(s) can be located between the outdoor unit 1 and the indoor units 2. In the case where the relay unit 3 is enclosed in separate casings, those casings may be connected via two, three, or four refrigerant pipes in which the first refrigerant flows, or via two, three, or four heat medium pipes in which the first heat medium flows. In the case where the relay unit 3 is enclosed in separate casings, the casings may be located close to or away from each other.

As shown in FIG. 1, in the air-conditioning apparatus according to Embodiment 1, the outdoor unit 1 and the relay unit 3 are connected to each other via the heat medium pipe 5*a* routed in two lines, and the relay unit 3 and each of the indoor units 2 are connected to each other via the heat medium pipe 5*b* routed in two lines. Thus, in the air-conditioning apparatus according to Embodiment 1, the units (outdoor unit 1, indoor units 2, and the relay unit 3) are connected to each via the pipes (heat medium pipe 5*a* and heat medium pipe 5*b*) each routed only in two lines, which facilitates the installation work.

Here, FIG. 1 illustrates the case where the relay unit 3 is located in the space 8 behind a ceiling. Instead, the relay unit 3 may be located, for example, in a common-use space where an elevator is installed. In addition, although the indoor units 2 shown in FIG. 1 are of a ceiling cassette type having the main body located behind the ceiling and the air outlet exposed in the indoor space 7, the indoor units 2 may be of a wall-mounted type having the main body located inside the indoor space 7, or of a ceiling-embedded type or a ceiling-suspension type having a duct or the like for supplying air into the indoor space 7. The indoor units 2 may be of any desired type provided that the heating air or cooling air can be blown into the indoor space 7 so as to satisfy the air-conditioning load in the indoor space 7.

Further, although FIG. 1 illustrates the case where the outdoor unit 1 is installed in the outdoor space 6, the outdoor unit 1 may be installed in a different location. For example, the outdoor unit 1 may be located in an enclosed space such as a machine room with a ventilation port, or inside the building 9 provided that waste heat can be discharged out of the building 9 through an exhaust duct. Alternatively, a water-cooled type outdoor unit 1 may be employed, so as to allow the outdoor unit 1 to be installed inside the building 9.

Although the relay unit 3 can be installed away from the outdoor unit 1, the relay unit 3 may also be installed in the vicinity of the outdoor unit 1. In addition, the number of units of the outdoor unit 1, the indoor units 2, and the relay unit 3 connected to each other is not limited to the number illustrated in FIG. 1, but may be determined depending on the condition of the building 9 in which the air-conditioning apparatus according to Embodiment 1 is to be installed.

Figure 2:
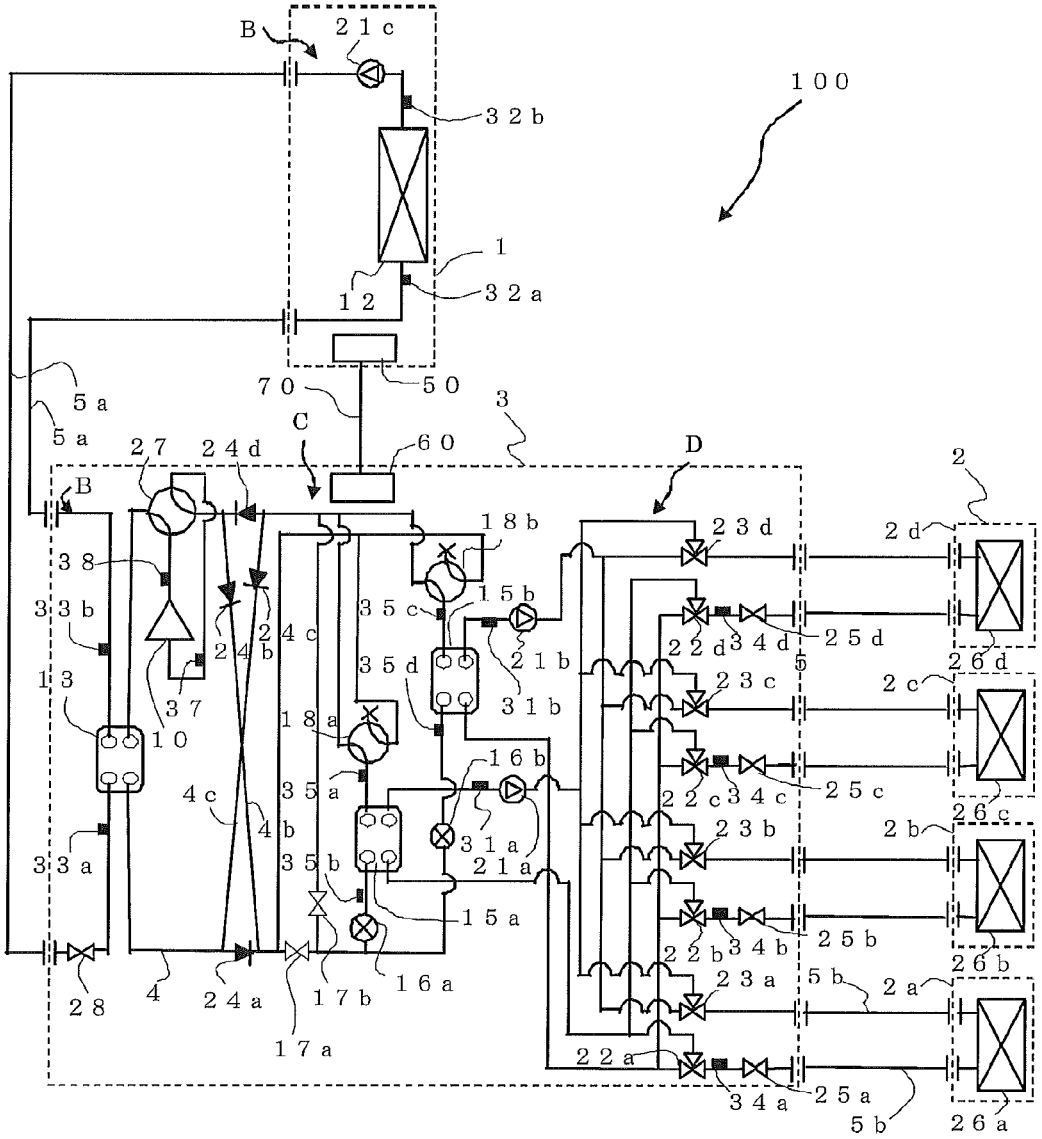
FIG. 2 is a schematic diagram showing a configuration of the air-conditioning apparatus according to Embodiment 1 of the present invention.

FIG. 2 is a schematic diagram showing a configuration of the air-conditioning apparatus (hereinafter, air-conditioning apparatus 100) according to Embodiment 1 of the present invention. Referring to FIG. 2, the detailed configuration of the air-conditioning apparatus 100 will be described. As shown in FIG. 2, outdoor unit 1 and the relay unit 3 are connected via the heat medium pipe 5*a* routed through an outdoor-side heat exchanger 12 in the outdoor unit 1 and a second heat medium heat exchanger 13 in the relay unit 3. The relay unit 3 and each of the indoor units 2 are connected to each other via the heat medium pipe 5*b* routed through the first intermediate heat exchanger 15*a* and the first intermediate heat exchanger 15*b*.

[Outdoor Unit 1]

The outdoor unit 1 includes a pump 21*c* for causing the second heat medium to circulate in the heat medium pipe 5*a* and the outdoor-side heat exchanger 12 that exchanges heat between the second heat medium and air in the outdoor space 6 (outer air). The pump 21*c* is located in the heat medium pipe 5*a* at a position corresponding to the outlet flow path of the outdoor-side heat exchanger 12, and may be, for example, a variable-capacity pump.

The outdoor unit 1 also includes an outdoor-side heat exchanger temperature sensor 32*a* and an outdoor-side heat exchanger temperature sensor 32*b*. The information detected by these sensors (temperature information) is transmitted to a controller 50 associated with the outdoor unit 1, to be utilized to control the rotation speed of a non-illustrated fan for blowing air to the outdoor-side heat exchanger 12, and the driving frequency of the pump 21*c*.

The outdoor-side heat exchanger temperature sensor 32*a* and the outdoor-side heat exchanger temperature sensor 32*b* serve to detect the temperature of the second heat medium flowing into and out of the outdoor-side heat exchanger 12, and may be constituted of a thermistor, for example. The outdoor-side heat exchanger temperature sensor 32*b* is located in the heat medium pipe 5*a* at a position between the outdoor-side heat exchanger 12 and the pump 21*c*. Instead, the outdoor-side heat exchanger temperature sensor 32*b* may be located in the flow path downstream of the pump 21*c*.

The controller 50 is constituted of a microcomputer for example, and serves to control the rotation speed of the non-illustrated fan provided for the outdoor-side heat exchanger 12 and the driving frequency of the pump 21*c*, according to the information detected by the sensors and instructions from a remote controller.

The heat medium pipe 5*a* in which the second heat medium flows is connected to the inlet and the outlet of the outdoor-side heat exchanger 12. The heat medium pipe 5*a* connected to the inlet of the outdoor-side heat exchanger 12 is connected to the relay unit 3, and the heat medium pipe 5*a* connected to the outlet of the outdoor-side heat exchanger 12 is connected to the relay unit 3 via the pump 21*c*.

[Indoor Unit 2]

The indoor units 2 each include a use-side heat exchanger 26. The use-side heat exchanger 26 is connected to a first heat medium flow control device 25 and to a second heat medium flow switching device 23 of the relay unit 3, via the heat medium pipe 5*b*. The use-side heat exchanger 26 serves to exchange heat between the air supplied by the non-illustrated fan and the heat medium, to thereby generate the heating air or cooling air to be supplied to the indoor space 7.

FIG. 2 illustrates the case where four indoor units 2 are connected to the relay unit 3, which are numbered as indoor unit 2*a*, indoor unit 2*b*, indoor unit 2*c*, and indoor unit 2*d* from the bottom of the drawing. Likewise, the use-side heat exchangers 26 are numbered as use-side heat exchanger 26*a*, use-side heat exchanger 26*b*, use-side heat exchanger 26*c*, and use-side heat exchanger 26*d* from the bottom, so as to respectively correspond to the indoor unit 2*a* to the indoor unit 2*d*. As stated with reference to FIG. 1, the number of indoor units 2 is not limited to four as illustrated in FIG. 2.

[Relay Unit 3]

The relay unit 3 includes a compressor 10, a first refrigerant flow switching device 27 constituted of a four-way valve for example, the second intermediate heat exchanger 13, a first expansion device 16*a* and a first expansion device 16*b*, the first intermediate heat exchanger 15*a* and the first intermediate heat exchanger 15*b*, a second refrigerant flow switching device 18*a* and a second refrigerant flow switching device 18*b*, which are serially connected via a refrigerant pipe 4, in which the first refrigerant circulates, and thus constitutes a first refrigerant circuit.

The relay unit 3 includes the first intermediate heat exchanger 15*a* and the first intermediate heat exchanger 15*b*, the first expansion device 16*a* and the first expansion device 16*b*, a pair of open/close devices 17, the pair of second refrigerant flow switching devices 18, a pump 21*a* and a pump 21*b*, four first heat medium flow switching devices 22, four of the second heat medium flow switching devices 23, and four of the first heat medium flow control devices 25, thus constituting the first heat medium circuit D.

Further, the relay unit 3 includes a refrigerant pipe 4*b* and a refrigerant pipe 4*c*, a check valve 24*a*, a check valve 24*b*, a check valve 24*c*, and a check valve 24*d*. These pipes and valves allow the first refrigerant flowing to the inlet side of the open/close device 17*a* to flow in a fixed direction, irrespective of the direction of the first refrigerant flow switching device 27. Accordingly, the refrigerant circuit for switching between cooling and heating of the first heat medium can be simplified, in each of the first intermediate heat exchanger 15*a* and the first intermediate heat exchanger 15*b*. Here, the check valve 24 may be excluded. The configuration without the check valve 24 will be subsequently described in Embodiment 2.

The compressor 10 sucks and compresses the first refrigerant, and then discharges the first refrigerant in a high-temperature/high-pressure state, and may be constituted of, for example, a variable-capacity inverter compressor.

The first refrigerant flow switching device 27 is constituted of a four-way valve for example, and serves to switch between a cooling operation in which the second intermediate heat exchanger 13 is caused to act as a condenser so as to transfer heat from the first refrigerant to the second heat medium, and a heating operation in which the second intermediate heat exchanger 13 is caused to act as an evaporator so as to cause the first refrigerant to remove heat from the second heat medium.

The second intermediate heat exchanger 13 acts as a condenser (including the case of causing the first refrigerant to transfer heat, though not to the extent of condensation, which also applies to subsequent description) or an evaporator (including the case of causing the first refrigerant to remove heat, though not to the extent of evaporation, which also applies to subsequent description), thereby serving to transmit the cooling energy or heating energy of the first refrigerant to the second heat medium. The second intermediate heat exchanger 13 is provided between the first refrigerant flow switching device 27 and the check valve 24*a* in the first refrigerant circuit C, for cooling or heating the second heat medium.

The first intermediate heat exchanger 15 (first intermediate heat exchanger 15*a*, first intermediate heat exchanger 15*b*) acts as a condenser or an evaporator, to transmit the cooling energy or heating energy of the first refrigerant to the first heat medium. The first intermediate heat exchanger 15*a* is provided between the first expansion device 16*a* and the second refrigerant flow switching device 18*a* in the first refrigerant circuit C, for cooling the heat medium in a cooling and heating mixed operation mode. The first intermediate heat exchanger 15*b* is provided between the first expansion device 16*b* and the second refrigerant flow switching device 18*b* in the first refrigerant circuit C, for heating the heat medium in the cooling and heating mixed operation mode.

The pair of first expansion devices 16 (first expansion device 16*a*, first expansion device 16*b*) have the function of a pressure reducing valve or an expansion valve, to depressurize and expand the first refrigerant. The first expansion device 16*a* is located upstream of the intermediate heat exchanger 15*a*, in the state where the first intermediate heat exchanger 15*a* acts as the evaporator. The first expansion device 16*b* is located upstream of the first intermediate heat exchanger 15*b* in the state where the intermediate heat exchanger 15*b* acts as the evaporator. The first expansion device 16*a* and the first expansion device 16*b* may be constituted of, for example, an electronic expansion valve with variable opening degree.

The pair of open/close devices 17 (open/close device 17*a*, open/close device 17*b*) may be constituted of a two-way valve, a solenoid valve, an electronic expansion valve, or the like, and serves to open and close the refrigerant pipe 4. The open/close device 17*a* is provided in the flow path connecting between the outlet side of the second intermediate heat exchanger 13 and the inlet side of the first expansion device 16, in the cooling operation. The open/close device 17*b* is provided at a position for connecting between the inlet side flow path of the first expansion device 16 and the outlet side flow path of the second refrigerant flow switching device 18, in the state where the first intermediate heat exchanger 15 acts as the evaporator.

The pair of second refrigerant flow switching devices 18 (second refrigerant flow switching device 18*a*, second refrigerant flow switching device 18*b*) serve to switch the flow of the refrigerant, depending on the operation mode. The second refrigerant flow switching device 18*a* is located downstream of the first intermediate heat exchanger 15*a*, in the state where the first intermediate heat exchanger 15*a* acts as the evaporator. The second refrigerant flow switching device 18*b* is located downstream of the first intermediate heat exchanger 15*b*, in the state where the first intermediate heat exchanger 15*a* acts as the evaporator. The second refrigerant flow switching devices 18 (second refrigerant flow switching device 18*a*, second refrigerant flow switching device 18*b*) may be constituted of a four-way valve, a two-way valve, a solenoid valve, or the like, and FIG. 2 illustrates the case where the four-way valve is employed.

The pair of pumps (first heat medium feeding devices) 21 (pump 21*a*, pump 21*b*) serve to cause the first heat medium to circulate in the heat medium pipe 5*b*. The pump 21*a* is located in the heat medium pipe 5*b* at a position between the first intermediate heat exchanger 15*a* and the second heat medium flow switching device 23. The pump 21*b* is located in the heat medium pipe 5*b* at a position between the first intermediate heat exchanger 15*b* and the second heat medium flow switching device 23. The pump 21*a* and the pump 21*b* may be constituted of a variable-capacity valve, for example.

The four first heat medium flow switching devices 22 (first heat medium flow switching device 22*a* to first heat medium flow switching device 22*d*) are each constituted of a three-way valve for example, and serve to switch the flow path of the heat medium. The number of first heat medium flow switching devices 22 corresponds to the number of indoor units 2 (four in Embodiment 1).

The first heat medium flow switching device 22 is provided on the outlet side of the heat medium flow path of the use-side heat exchanger 26, with one of the three ways connected to the first intermediate heat exchanger 15*a*, another way connected to the first intermediate heat exchanger 15*b*, and the remaining way connected to the first heat medium flow control device 25. The first heat medium flow switching devices 22 are each numbered as first heat medium flow switching device 22*a*, first heat medium flow switching device 22*b*, first heat medium flow switching device 22*c*, and first heat medium flow switching device 22*d* from the bottom of FIG. 2, so as to correspond to the indoor units 2.

The four second heat medium flow switching devices 23 (second heat medium flow switching device 23*a* to second heat medium flow switching device 23*d*) are each constituted of a three-way valve for example, and serve to switch the flow path of the heat medium. The number of second heat medium flow switching devices 23 corresponds to the number of indoor units 2 (four in Embodiment 1). The second heat medium flow switching device 23 is provided on the inlet side of the heat medium flow path of the use-side heat exchanger 26, with one of the three ways connected to the first intermediate heat exchanger 15*a*, another way connected to the first intermediate heat exchanger 15*b*, and the remaining way connected to the use-side heat exchanger 26. The second heat medium flow switching devices 23 are each numbered as second heat medium flow switching device 23*a*, second heat medium flow switching device 23*b*, second heat medium flow switching device 23*c*, and second heat medium flow switching device 23*d* from the bottom of FIG. 2, so as to correspond to the indoor units 2. It is not mandatory that the first heat medium flow switching device 22 and the second heat medium flow switching device 23 are formed separately from each other, and the first heat medium flow switching device 22 and the second heat medium flow switching device 23 may be formed in a unified configuration provided that the flow path of the first heat medium flowing in the use-side heat exchanger 26 can be switched on the sides of the pump 21*a* and the pump 22.

The four first heat medium flow control devices 25 (first heat medium flow control device 25*a* to first heat medium flow control device 25*d*) are each constituted of, for example, a two-way valve with variable opening degree, and controls the flow rate in the heat medium pipe 5*b*. The number of first heat medium flow control devices 25 corresponds to the number of indoor units 2 (four in Embodiment 1). The first heat medium flow control device 25 is located on the outlet side of the heat medium flow path of the use-side heat exchanger 26, with one way connected to the use-side heat exchanger 26 and the other way connected to the first heat medium flow switching device 22. The first heat medium flow control devices 25 are numbered as first heat medium flow control device 25*a*, first heat medium flow control device 25*b*, first heat medium flow control device 25*c*, and first heat medium flow control device 25*d* from the bottom in FIG. 2, so as to correspond to the indoor units 2. The first heat medium flow control device 25 may be located on the inlet side of the heat medium flow path of the use-side heat exchanger 26. It is not mandatory that the first heat medium flow control device 25 is separately formed from the first heat medium flow switching device 22 and the second heat medium flow switching device 23, and the first heat medium flow control device 25 may be formed in a unified configuration with either or both of the first heat medium flow switching device 22 and the second heat medium flow switching device 23, provided that the flow rate of the first heat medium flowing in the heat medium pipe 5*b* can be controlled.

A second heat medium flow switching device 28 is constituted of, for example, a two-way valve with variable opening degree, and serves to control the flow rate of the second heat medium flowing in the second intermediate heat exchanger 13. The second heat medium flow switching device 28 is provided to the heat medium pipe 5*a* in which the second heat medium flows, at a position corresponding to the inlet flow path of the second intermediate heat exchanger 13. The second heat medium flow switching device 28 may be provided in the outlet flow path of the second intermediate heat exchanger 13. The opening degree of the second heat medium flow switching device 28 is controlled so that, for example, a difference between a temperature detected by the intermediate heat exchanger temperature sensor 33*b* and a temperature detected by the intermediate heat exchanger temperature sensor 33*a* becomes constant.

Further, the relay unit 3 includes various sensors such as two intermediate heat exchanger outlet temperature sensors 31*a* and 31*b*, two intermediate heat exchanger temperature sensors 33*a* and 33*b*, four use-side heat exchanger outlet temperature sensors 34*a* to 34*d*, six intermediate heat exchanger refrigerant temperature sensors 35*a* to 35*d*, low-pressure refrigerant pressure sensor 37, and high-pressure refrigerant pressure sensor 38. The information detected by these sensors (temperature information, pressure information) is transmitted to a controller 60 associated with the relay unit 3, to be utilized for controlling the driving frequency of the compressor 10, the switching of the first refrigerant flow switching device 27, the opening degree of the first expansion device 16, the opening and closing of the on/off valve 17, the switching of the second refrigerant flow switching device 18, the driving frequency of the pump 21, the switching of the first heat medium flow switching device 22, the switching of the second heat medium flow switching device 23, the opening degree of the first heat medium flow control device 25, and the opening degree of the second heat medium flow control device 28.

The two intermediate heat exchanger outlet temperature sensors 31 (intermediate heat exchanger outlet temperature sensor 31*a*, intermediate heat exchanger outlet temperature sensor 31*b*) respectively serve to detect the temperature of the first heat medium flowing out of the first intermediate heat exchanger 15*a* and the first intermediate heat exchanger 15*b*, and may be constituted of a thermistor for example. The intermediate heat exchanger outlet temperature sensor 31*a* is provided to the heat medium pipe 5*b* at a position corresponding to the inlet side of the pump 21*a*. The intermediate heat exchanger outlet temperature sensor 31*b* is provided to the heat medium pipe 5*b* at a position corresponding to the inlet side of the pump 21*b*.

The four use-side heat exchanger outlet temperature sensors 34 (use-side heat exchanger outlet temperature sensor 34*a* to use-side heat exchanger outlet temperature sensor 34*d*) are each provided between the first heat medium flow switching device 22 and the first heat medium flow control device 25 to detect the temperature of the first heat medium flowing out of the use-side heat exchanger 26, and may be constituted of a thermistor for example. The number of use-side heat exchanger outlet temperature sensors 34 corresponds to the number of indoor units 2 (four in Embodiment 1). The use-side heat exchanger outlet temperature sensors 34 are numbered as use-side heat exchanger outlet temperature sensor 34*a*, use-side heat exchanger outlet temperature sensor 34*b*, use-side heat exchanger outlet temperature sensor 34*c*, and use-side heat exchanger outlet temperature sensor 34*d* from the bottom in FIG. 2, so as to correspond to the indoor units 2. The use-side heat exchanger outlet temperature sensor 34 may be provided in the flow path between the first heat medium flow control device 25 and the use-side heat exchanger 26.

The four intermediate heat exchanger refrigerant temperature sensors 35 (intermediate heat exchanger refrigerant temperature sensor 35*a* to intermediate heat exchanger refrigerant temperature sensor 35*d*) are each provided on the inlet side or outlet side of the refrigerant of the first intermediate heat exchanger 15, to detect the temperature of the first refrigerant flowing into or out of the first intermediate heat exchanger 15, and may be constituted of a thermistor for example. The intermediate heat exchanger refrigerant temperature sensor 35*a* is provided between the first intermediate heat exchanger 15*a* and the second refrigerant flow switching device 18*a*. The intermediate heat exchanger refrigerant temperature sensor 35*b* is provided between the first intermediate heat exchanger 15*a* and the first expansion device 16*a*. The intermediate heat exchanger refrigerant temperature sensor 35*c* is provided between the first intermediate heat exchanger 15*b* and the second refrigerant flow switching device 18*b*. The intermediate heat exchanger refrigerant temperature sensor 35*d* is provided between the first intermediate heat exchanger 15*b* and the first expansion device 16*b*.

The intermediate heat exchanger temperature sensor 33*a* is provided in the flow path of the heat medium at a position on the inlet side of the second intermediate heat exchanger 13, to detect the temperature of the second heat medium flowing into the second intermediate heat exchanger 13. The intermediate heat exchanger temperature sensor 33*b* is provided in the flow path of the heat medium at a position on the outlet side of the second intermediate heat exchanger 13, to detect the temperature of the second heat medium flowing out of the second intermediate heat exchanger 13. The intermediate heat exchanger temperature sensor 33*a* and the intermediate heat exchanger temperature sensor 33*b* may be constituted of, for example, a thermistor.

The low-pressure refrigerant pressure sensor 37 is provided in the suction flow path of the compressor 10, to detect the pressure of the first refrigerant flowing into the compressor 10. The high-pressure refrigerant pressure sensor 38 is provided in the discharge flow path of the compressor 10, to detect the pressure of the first refrigerant discharged from the compressor 10.

The controller 60 is constituted of a microcomputer for example, and controls the driving frequency of the compressor 10, the switching of the first refrigerant flow switching device 27, the driving frequency of the pump 21*a* and the pump 21*b*, the opening degree of the first expansion device 16*a* and the first expansion device 16*b*, the opening and closing of the open/close device 17, the switching of the second refrigerant flow switching device 18, the switching of the first heat medium flow switching device 22, the switching of the second heat medium flow switching device 23, the opening degree of the first heat medium flow control device 25, and the opening degree of the second heat medium flow control device 28, according to the information detected by the sensors and instructions from the remote controller, to thereby perform the operation modes to be subsequently described.

The heat medium pipe 5*a* in which the second heat medium flows is connected to the inlet and the outlet of the second intermediate heat exchanger 13. The heat medium pipe 5*a* connected to the outlet of the second intermediate heat exchanger 13 is connected to the outdoor unit 1, and the heat medium pipe 5*a* connected to the inlet of the second intermediate heat exchanger 13 is connected to the outdoor unit 1 via the second heat medium flow control device 28.

The heat medium pipe 5*b* in which the first heat medium flows includes a section connected to the first intermediate heat exchanger 15*a* and a section connected to the first intermediate heat exchanger 15*b*. The heat medium pipe 5*b* is split into the number of branches corresponding to the number of indoor units 2 connected to the relay unit 3 (four in Embodiment 1). The heat medium pipe 5*b* is connected at the first heat medium flow switching device 22, and the second heat medium flow switching device 23. It is decided whether the heat medium from the first intermediate heat exchanger 15*a* or the heat medium from the first intermediate heat exchanger 15*b* is to be introduced into the use-side heat exchanger 26, by controlling the action of the first heat medium flow switching device 22 and the second heat medium flow switching device 23.

In the air-conditioning apparatus 100, the compressor 10, the first refrigerant flow switching device 27, the refrigerant flow path of the second intermediate heat exchanger 13, the open/close device 17, the first expansion device 16, the refrigerant flow path of the first intermediate heat exchanger 15, and the second refrigerant flow switching device 18 are connected via the refrigerant pipe 4, thus constituting the first refrigerant circuit C in the relay unit 3. In addition, the heat source-side heat exchanger 12, the pump 21*c*, the second heat medium flow control device 28, and the second intermediate heat exchanger 13 are connected via the heat medium pipe 5*a* so as to constitute the second heat medium circuit B for circulation between the outdoor unit 1 and the relay unit 3, and likewise the heat medium flow path of the first intermediate heat exchanger 15, the pump 21*a* and the pump 21*b*, the first heat medium flow switching device 22, the first heat medium flow control device 25, the use-side heat exchanger 26, and the second heat medium flow switching device 23 are connected via the heat medium pipe 5*b*, so as to constitute the first heat medium circuit D for circulation between the relay unit 3 and each of the indoor units 2. Each of the plurality of use-side heat exchangers 26 is connected in parallel to each of the first intermediate heat exchangers 15, thus constituting the plurality of lines of the first heat medium circuit D.

Thus, in the air-conditioning apparatus 100 the outdoor unit 1 and the relay unit 3 are connected to each other via the second intermediate heat exchanger 13 in the relay unit 3, and the relay unit 3 and each of the indoor units 2 are connected to each other via the first intermediate heat exchanger 15*a* and the first intermediate heat exchanger 15*b*. In the air-conditioning apparatus 100, the second heat medium circulating in the second heat medium circuit B of the outdoor unit 1 and air in the outdoor space 6 exchange heat with each other in the outdoor-side heat exchanger 12, and the first refrigerant circulating in the first refrigerant circuit C of the relay unit 3 and the second heat medium transported from the outdoor unit 1 exchange heat with each other in the second intermediate heat exchanger 13. Further, the first refrigerant circulating in the first refrigerant circuit C of the relay unit 3 and the first heat medium circulating in the first heat medium circuit D of the relay unit 3 exchange heat with each other in the first intermediate heat exchanger 15*a* and the first intermediate heat exchanger 15*b*.

In the mentioned process, although the first heat medium and the second heat medium both flow into and out of the relay unit 3, the flow paths are divided and hence the first heat medium and the second heat medium are kept from being mixed with each other.

The operation modes performed by the air-conditioning apparatus 100 will be described hereunder. The air-conditioning apparatus 100 is configured to receive an instruction from each of the indoor units 2 and to cause the corresponding indoor unit 2 to perform the cooling operation or heating operation. In other words, the air-conditioning apparatus 100 is configured to cause all of the indoor units 2 to perform the same operation, or allow each of the indoor units 2 to perform a different operation.

The operation modes that the air-conditioning apparatus 100 is configured to perform include a cooling-only operation mode in which all of the indoor units 2 in operation perform the cooling operation, a heating-only operation mode in which all of the indoor units 2 in operation perform the heating operation, a cooling-main operation mode in which the load of cooling is greater, and a heating-main operation mode in which the load of heating is greater. Each of the operation modes will be described hereunder, along with the flow of the refrigerant and the heat medium.

[Cooling-Only Operation Mode]

Figure 3:
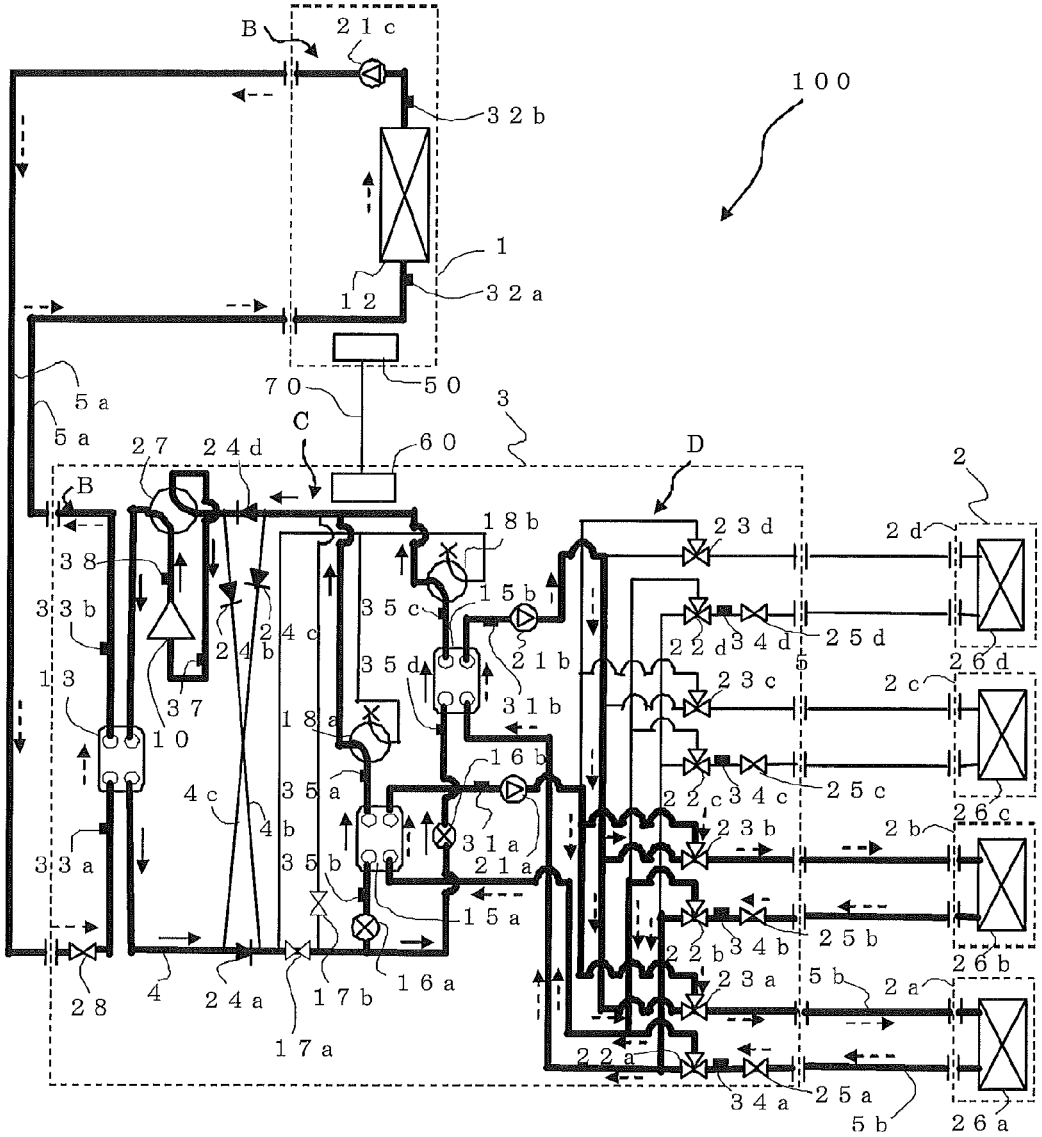
FIG. 3 is a circuit diagram showing the flow of refrigerant and a heat medium in the air-conditioning apparatus according to Embodiment 1 of the present invention, in a cooling-only operation.

FIG. 3 is a circuit diagram showing the flow of the refrigerant and the heat medium in the air-conditioning apparatus 100, in the cooling-only operation. Referring to FIG. 3, the cooling-only operation mode will be described on the assumption that the cooling load has arisen only in the use side heat exchanger 26*a* and the use side heat exchanger 26*b*. In FIG. 3, the pipes illustrated in bold lines represent the pipes in which the refrigerant and the heat medium flow. In addition, the flow of the refrigerant is indicated by solid arrows and the flow of the heat medium is indicated by broken-line arrows.

In the cooling-only operation mode shown in FIG. 3, the pump 21*c* in the outdoor unit 1 is driven, so as to circulate the second heat medium. In the relay unit 3, the first refrigerant flow switching device 27 is switched so as to cause the refrigerant discharged from the compressor 10 to flow into the second intermediate heat exchanger 13, and the pump 21*a* and the pump 21*b* are activated. The first heat medium flow control device 25*a* and the first heat medium flow control device 25*b* are fully opened, while the first heat medium flow control device 25*c* and the first heat medium flow control device 25*d* are fully closed, so as to allow the heat medium to circulate between each of the first intermediate heat exchanger 15*a* and the first intermediate heat exchanger 15*b* and each of the use-side heat exchanger 26*a* and the use-side heat exchanger 26*b*.

First, the flow of the second heat medium from the outdoor unit 1 to the relay unit 3 in the second heat medium circuit B will be described.

In the cooling-only operation mode, the heating energy of the second heat medium is transferred to the outdoor space 6 in the outdoor-side heat exchanger 12, and the pump 21*c* causes the cooled second heat medium to flow through the heat medium pipe 5*a*. The second heat medium pressurized by the pump 21*c* and discharged therefrom flows out of the outdoor unit 1 and flows into the relay unit 3 through the heat medium pipe 5*a*, and then flows into the second intermediate heat exchanger 13 through the second heat medium flow control device 28. In the second intermediate heat exchanger 13, the cooling energy of the second heat medium is transferred to the first refrigerant, after which the second heat medium flows out of the relay unit 3 and flows into the outdoor unit 1 through the heat medium pipe 5*a*, and then again flows into the outdoor-side heat exchanger 12.

In this process, the heat medium flow control device 28 controls the opening degree so that a difference between the temperature of the second heat medium on the outlet side of the second intermediate heat exchanger 13 detected by the intermediate heat exchanger temperature sensor 33*b* and the temperature of the second heat medium on the inlet side of the second intermediate heat exchanger 13 detected by the intermediate heat exchanger temperature sensor 33*a* matches a target value. Then the rotation speed of the pump 21*c* is controlled so that the opening degree of the heat medium flow control device 28 thus controlled becomes as close as possible to full-open. More specifically, when the opening degree of the heat medium flow control device 28 is considerably smaller than full-open, the rotation speed of the pump 21*c* is reduced. When the opening degree of the heat medium flow control device 28 is close to full-open, the pump 21*c* is controlled so as to maintain the same flow rate of the second heat medium. It is not mandatory that the heat medium flow control device 28 is fully opened, but it suffices that the heat medium flow control device 28 is opened to a substantially high degree, such as 90% or 85% of the fully opened state. In this case, the controller 60 controlling the opening degree of the heat medium flow control device 28 is located inside or close to the relay unit 3, and the controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the heat medium flow control device 28 to the controller 50 of the outdoor unit 1 through wired or wireless communication line connecting between the relay unit 3 and the outdoor unit 1, to thereby perform a linkage control described as above. The controller 50 of the outdoor unit 1 also controls the non-illustrated fan provided for the outdoor-side heat exchanger 12.

Hereunder, the flow of the first refrigerant in the first refrigerant circuit C in the relay unit 3 will be described.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 flows into the second intermediate heat exchanger 13 acting as a condenser, through the first refrigerant flow switching device 27, and is condensed and liquefied while transferring heat to the second heat medium in the second intermediate heat exchanger 13, thereby turning into high-pressure liquid refrigerant. In this process the flow path is formed so that the second heat medium and the first refrigerant flow in opposite directions to each other in the second intermediate heat exchanger 13. The high-pressure liquid refrigerant which has flowed out of the second intermediate heat exchanger 13 is branched after flowing through the check valve 24*a* and the open/close device 17*a*, and expanded in the first expansion device 16*a* and the first expansion device 16*b* thus to turn into low-temperature/low-pressure two-phase refrigerant. The two-phase refrigerant flows into each of the first intermediate heat exchanger 15*a* and the first intermediate heat exchanger 15*b* acting as an evaporator, and cools the first heat medium circulating in the first heat medium circuit D by removing heat from the first heat medium, thereby turning into low-temperature/low-pressure gas refrigerant. In this process the flow path is formed so that the first refrigerant and the first heat medium flow parallel to each other in the first intermediate heat exchanger 15*a* and the first intermediate heat exchanger 15*b*. The gas refrigerant which has flowed out of the first intermediate heat exchanger 15*a* and the first intermediate heat exchanger 15*b* flows through the second refrigerant flow switching device 18*a* and the second refrigerant flow switching device 18*b*, the check valve 24*d*, and the first refrigerant flow switching device 27, and is again sucked into the compressor 10.

In the mentioned process, the opening degree of the first expansion device 16*a* is controlled so as to keep a degree of superheating at a constant level, the degree of superheating representing a difference between the temperature detected by the intermediate heat exchanger refrigerant temperature sensor 35*a* and the temperature detected by the intermediate heat exchanger refrigerant temperature sensor 35*b*. Likewise, the opening degree of the first expansion device 16*b* is controlled so as to keep a degree of superheating at a constant level, the degree of superheating representing a difference between the temperature detected by the intermediate heat exchanger refrigerant temperature sensor 35*c* and the temperature detected by the intermediate heat exchanger refrigerant temperature sensor 35*d*. Here, the open/close device 17*a* is opened and the open/close device 17*b* is closed.

In addition, the compressor 10 is controlled so that the pressure (low pressure) of the first refrigerant detected by the low-pressure refrigerant pressure sensor 37 matches a target pressure, for example the saturation pressure corresponding to 0 degrees Celsius. Alternatively, the frequency of the compressor 10 may be controlled so that the temperature detected by the intermediate heat exchanger outlet temperature sensor 31*a* and/or the temperature detected by the intermediate heat exchanger outlet temperature sensor 31*b* becomes close to a target temperature.

The flow of the first heat medium in the first heat medium circuit D will now be described.

In the cooling-only operation mode, the cooling energy of the first refrigerant is transmitted to the first heat medium in both of the first intermediate heat exchanger 15*a* and the first intermediate heat exchanger 15*b*, and the cooled first heat medium is driven by the pump 21*a* and the pump 21*b* to flow through the pipe 5*b*. The first heat medium pressurized by the pump 21*a* and the pump 21*b* and discharged therefrom flows into the use-side heat exchanger 26*a* and the use-side heat exchanger 26*b*, through the second heat medium flow switching device 23*a* and the second heat medium flow switching device 23*b*. Then the first heat medium removes heat from indoor air in the use-side heat exchanger 26*a* and the use-side heat exchanger 26*b*, thereby cooling the indoor space 7.

Thereafter, the first heat medium flows out of the use-side heat exchanger 26*a* and the use-side heat exchanger 26*b* and flows into the first heat medium flow control device 25*a* and the first heat medium flow control device 25*b*. In the mentioned process, the flow rate of the first heat medium flowing into the use-side heat exchanger 26*a* and the use-side heat exchanger 26*b* is controlled by the first heat medium flow control device 25*a* and the first heat medium flow control device 25*b* so as to satisfy the air-conditioning load required in the indoor space. The heat medium which has flowed out of the first heat medium flow control device 25*a* and the first heat medium flow control device 25*b* passes through the first heat medium flow switching device 22*a* and the first heat medium flow switching device 22*b*, and flows into the first intermediate heat exchanger 15*a* and the first intermediate heat exchanger 15*b*, and is again sucked into the pump 21*a* and the pump 21*b*.

In the pipe 5*b* in the use-side heat exchanger 26, the first heat medium flows in the direction from the second heat medium flow switching device 23 toward the first heat medium flow switching device 22 through the first heat medium flow control device 25. The air-conditioning load required in the indoor space 7 can be satisfied by controlling so as to maintain at a target value the difference between the temperature detected by the intermediate heat exchanger outlet temperature sensor 31*a* or the temperature detected by the intermediate heat exchanger outlet temperature sensor 31*b* and the temperature detected by the use-side heat exchanger outlet temperature sensor 34. Either of the temperatures detected by the intermediate heat exchanger outlet temperature sensor 31*a* and the intermediate heat exchanger outlet temperature sensor 31*b*, or the average temperature thereof, may be adopted as the temperature at the outlet of the first intermediate heat exchanger 15. In the mentioned process, the first heat medium flow switching device 22 and the second heat medium flow switching device 23 are set to an opening degree that allows the flow path to be secured in both of the first intermediate heat exchanger 15*a* and the first intermediate heat exchanger 15*b*, and allows the flow rate to accord with the heat exchange amount.

During the cooling-only operation mode, the flow path to the use-side heat exchanger 26 where the thermal load has not arisen (including a state where a thermostat is off) is closed by the first heat medium flow control device 25 to restrict the flow of the heat medium, since it is not necessary to supply the heat medium to such use-side heat exchanger 26. In FIG. 3, the thermal load is present in the use-side heat exchanger 26*a* and the use-side heat exchanger 26*b* and hence the heat medium is supplied thereto, however the thermal load has not arisen in the use-side heat exchanger 26*c* and the use-side heat exchanger 26*d*, and therefore the corresponding first heat medium flow control device 25*c* and first heat medium flow control device 25*d* are fully closed. When the thermal load arises in the use-side heat exchanger 26*c* or the use-side heat exchanger 26*d*, the first heat medium flow control device 25*c* or the first heat medium flow control device 25*d* may be opened so as to allow the heat medium to circulate.

[Heating-Only Operation Mode]

Figure 4:
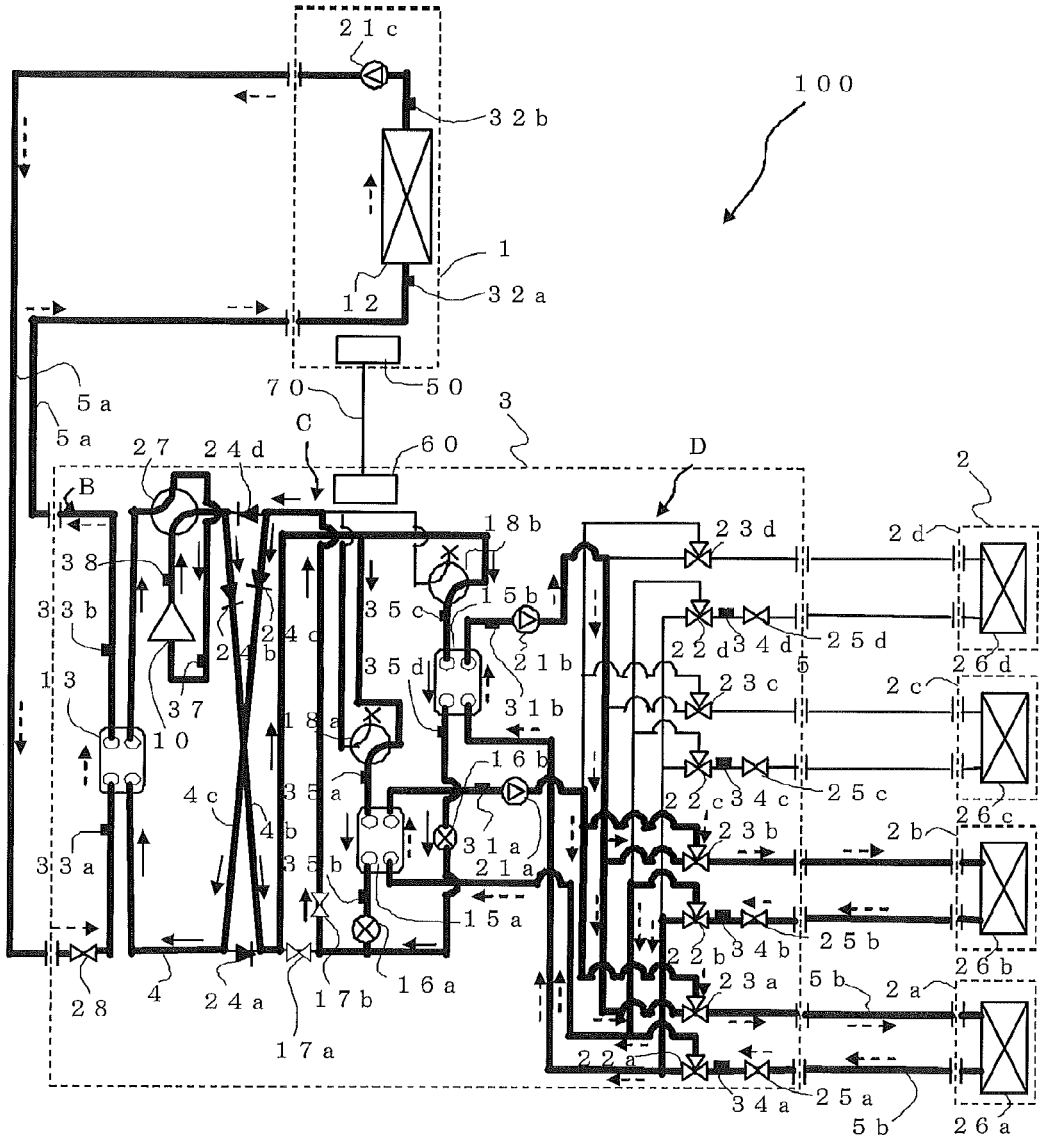
FIG. 4 is a circuit diagram showing the flow of the refrigerant and the heat medium in the air-conditioning apparatus according to Embodiment 1 of the present invention, in a heating-only operation.

FIG. 4 is a circuit diagram showing the flow of the refrigerant and the heat medium in the air-conditioning apparatus 100 according to Embodiment 1 of the present invention, in the heating-only operation. Referring to FIG. 4, the heating-only operation mode will be described on the assumption that the heating load has arisen only in the use side heat exchanger 26*a* and the use side heat exchanger 26*b*. In FIG. 4, the pipes illustrated in bold lines represent the pipes in which the refrigerant and the heat medium flow. In addition, the flow of the refrigerant is indicated by solid arrows and the flow of the heat medium is indicated by broken-line arrows.

In the heating-only operation mode shown in FIG. 4, the pump 21*c* in the outdoor unit 1 is driven, so as to circulate the second heat medium. In the relay unit 3, the first refrigerant flow switching device 27 is switched so as to cause the refrigerant discharged from the second intermediate heat exchanger 13 to flow into the compressor 10, and the pump 21*a* and the pump 21*b* are activated. The first heat medium flow control device 25*a* and the first heat medium flow control device 25*b* are fully opened, while the first heat medium flow control device 25*c* and the first heat medium flow control device 25*d* are fully closed, so as to allow the heat medium to circulate between each of the first intermediate heat exchanger 15*a* and the first intermediate heat exchanger 15*b* and each of the use-side heat exchanger 26*a* and the use-side heat exchanger 26*b*.

First, the flow of the second heat medium from the outdoor unit 1 to the relay unit 3 in the second heat medium circuit B will be described.

In the heating-only operation mode, the second heat medium removes heat from the outdoor space 6 in the outdoor-side heat exchanger 12, and the pump 21*c* causes the heated second heat medium to flow through the heat medium pipe 5*a*. The second heat medium pressurized by the pump 21*c* and discharged therefrom flows out of the outdoor unit 1 and flows into the relay unit 3 through the heat medium pipe 5*a*, and then flows into the second intermediate heat exchanger 13 through the second heat medium flow control device 28. In the second intermediate heat exchanger 13, the heating energy of the second heat medium is transferred to the second refrigerant, after which the second heat medium flows out of the relay unit 3 and flows into the outdoor unit 1 through the heat medium pipe 5*a*, and then again flows into the outdoor-side heat exchanger 12.

In this process, the heat medium flow control device 28 controls the opening degree so that a difference between the temperature of the second heat medium on the inlet side of the second intermediate heat exchanger 13 detected by the intermediate heat exchanger temperature sensor 33*a* and the temperature of the second heat medium on the outlet side of the second intermediate heat exchanger 13 detected by the intermediate heat exchanger temperature sensor 33*b* matches a target value. Then the rotation speed of the pump 21*c* is controlled so that the opening degree of the heat medium flow control device 28 thus controlled becomes as close as possible to full-open. More specifically, when the opening degree of the heat medium flow control device 28 is considerably smaller than full-open, the rotation speed of the pump 21*c* is reduced. When the opening degree of the heat medium flow control device 28 is close to full-open, the pump 21*c* is controlled so as to maintain the same flow rate of the second heat medium. It is not mandatory that the heat medium flow control device 28 is fully opened, but it suffices that the heat medium flow control device 28 is opened to a substantially high degree, such as 90% or 85% of the fully opened state. In this case, the controller 60 controlling the opening degree of the heat medium flow control device 28 is located inside or close to the relay unit 3, and the controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the heat medium flow control device 28 to the controller 50 of the outdoor unit 1 through wired or wireless communication line connecting between the relay unit 3 and the outdoor unit 1, to thereby perform a linkage control described as above. The controller 50 of the outdoor unit 1 also controls the non-illustrated fan provided for the outdoor-side heat exchanger 12.

Hereunder, the flow of the first refrigerant in the first refrigerant circuit C in the relay unit 3 will be described.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 passes through the first refrigerant flow switching device 27, the check valve 24*b*, and the refrigerant pipe 4*b*, and is branched so as to pass through the second refrigerant flow switching device 18*a* and the second refrigerant flow switching device 18*b*, and then flows into the first intermediate heat exchanger 15*a* and the first intermediate heat exchanger 15*b* acting as a condenser. The high-temperature/high-pressure gas refrigerant which has entered the first intermediate heat exchanger 15*a* and the first intermediate heat exchanger 15*b* is condensed and liquefied while transferring heat to the first heat medium circulating in the first heat medium circuit D, thereby turning into high-pressure liquid refrigerant. In this process the flow path is formed so that the first heat medium and the first refrigerant flow in opposite directions to each other in the first intermediate heat exchanger 15*a* and the first intermediate heat exchanger 15*b*. The liquid refrigerant which has flowed out of the first intermediate heat exchanger 15*a* and the first intermediate heat exchanger 15*b* is expanded in the first expansion device 16*a* and the first expansion device 16*b* thus to turn into low-temperature/low-pressure two-phase refrigerant, and passes through the open/close device 17*b* and then flows into the second intermediate heat exchanger 13 acting as an evaporator, through the check valve 24*c* and the refrigerant pipe 4*c*. The refrigerant which has entered the second intermediate heat exchanger 13 removes heat from the second heat medium flowing in the second heat medium circuit B, thereby turning into low-temperature/low-pressure gas refrigerant, and is again sucked into the compressor 10 through the first refrigerant flow switching device 27. In this process the flow path is formed so that the first refrigerant and the second heat medium flow parallel to each other in the second intermediate heat exchanger 13.

In the mentioned process, the opening degree of the first expansion device 16*a* is controlled so as to keep a degree of subcooling at a constant level, the degree of subcooling representing a difference between a saturation temperature calculated from the pressure (high pressure) of the first refrigerant detected by the high-pressure refrigerant pressure sensor 38 and the temperature detected by the intermediate heat exchanger refrigerant temperature sensor 35*b*. Likewise, the opening degree of the first expansion device 16*b* is controlled so as to keep a degree of subcooling at a constant level, the degree of subcooling representing a difference between a saturation temperature calculated from the pressure (high pressure) of the first refrigerant detected by the high-pressure refrigerant pressure sensor 38 and the temperature detected by the intermediate heat exchanger refrigerant temperature sensor 35*d*. In addition, the open/close device 17*a* is opened and the open/close device 17*b* is closed. Here, in the case where the temperature at an intermediate position of the first intermediate heat exchanger 15 is measurable, the temperature at the intermediate position may be used instead of the high-pressure refrigerant pressure sensor 38, in which case the system can be formed at a lower cost.

In addition, the compressor 10 is controlled so that the pressure (high pressure) of the first refrigerant detected by the high-pressure refrigerant pressure sensor 38 matches a target pressure, for example the saturation pressure corresponding to 49 degrees Celsius. Alternatively, the frequency of the compressor 10 may be controlled so that the temperature detected by the intermediate heat exchanger outlet temperature sensor 31*a* and/or the temperature detected by the intermediate heat exchanger outlet temperature sensor 31*b* becomes close to a target temperature.

The flow of the first heat medium in the first heat medium circuit D will now be described.

In the heating-only operation mode, the heating energy of the first refrigerant is transmitted to the heat medium in both of the first intermediate heat exchanger 15*a* and the first intermediate heat exchanger 15*b*, and the heated heat medium is driven by the pump 21*a* and the pump 21*b* to flow through the pipe 5*b*. The first heat medium pressurized by the pump 21*a* and the pump 21*b* and discharged therefrom flows into the use-side heat exchanger 26*a* and the use-side heat exchanger 26*b*, through the second heat medium flow switching device 23*a* and the second heat medium flow switching device 23*b*. Then the heat medium transfers heat to indoor air in the use-side heat exchanger 26*a* and the use-side heat exchanger 26*b*, thereby heating the indoor space 7.

Thereafter, the first heat medium flows out of the use-side heat exchanger 26*a* and the use-side heat exchanger 26*b* and flows into the first heat medium flow control device 25*a* and the first heat medium flow control device 25*b*. In the mentioned process, the flow rate of the first heat medium flowing into the use-side heat exchanger 26*a* and the use-side heat exchanger 26*b* is controlled by the first heat medium flow control device 25*a* and the first heat medium flow control device 25*b* so as to satisfy the air-conditioning load required in the indoor space. The first heat medium which has flowed out of the first heat medium flow control device 25*a* and the first heat medium flow control device 25*b* passes through the first heat medium flow switching device 22*a* and the first heat medium flow switching device 22*b*, and flows into the first intermediate heat exchanger 15*a* and the first intermediate heat exchanger 15*b*, and is again sucked into the pump 21*a* and the pump 21*b*.

In the pipe 5*b* in the use-side heat exchanger 26, the heat medium flows in the direction from the second heat medium flow switching device 23 toward the first heat medium flow switching device 22 through the first heat medium flow control device 25. The air-conditioning load required in the indoor space 7 can be satisfied by controlling so as to maintain at a target value the difference between the temperature detected by the intermediate heat exchanger outlet temperature sensor 31*a* or the temperature detected by the intermediate heat exchanger outlet temperature sensor 31*b* and the temperature detected by the use-side heat exchanger outlet temperature sensor 34. Either of the temperatures detected by the intermediate heat exchanger outlet temperature sensor 31*a* and the intermediate heat exchanger outlet temperature sensor 31*b*, or the average temperature thereof, may be adopted as the temperature at the outlet of the first intermediate heat exchanger 15. In the mentioned process, the first heat medium flow switching device 22 and the second heat medium flow switching device 23 are set to an opening degree that allows the flow path to be secured in both of the first intermediate heat exchanger 15*a* and the first intermediate heat exchanger 15*b*, and allows the flow rate to accord with the heat exchange amount. Here, although in principle it is desirable to control the use side heat exchanger 26*a* on the basis of the difference in temperature between the inlet and the outlet thereof, actually the heat medium temperature at the inlet of the use side heat exchangers 26 is nearly the same as the temperature detected by the intermediate heat exchanger outlet temperature sensor 31*a* or the intermediate heat exchanger outlet temperature sensor 31*b*, and therefore adopting the value of the intermediate heat exchanger outlet temperature sensor 31*a* and/or the intermediate heat exchanger outlet temperature sensor 31*b* allows reduction of the number of temperature sensors, which leads to reduction in cost of the system.

During the heating-only operation mode, the flow path to the use-side heat exchanger 26 where the thermal load has not arisen (including a state where a thermostat is off) is closed by the first heat medium flow control device 25 to restrict the flow of the heat medium, since it is not necessary to supply the heat medium to such use-side heat exchanger 26. In FIG. 4, the thermal load is present in the use-side heat exchanger 26*a* and the use-side heat exchanger 26*b* and hence the heat medium is supplied thereto, however the thermal load has not arisen in the use-side heat exchanger 26*c* and the use-side heat exchanger 26*d*, and therefore the corresponding first heat medium flow control device 25*c* and first heat medium flow control device 25*d* are fully closed. When the thermal load arises in the use-side heat exchanger 26*c* or the use-side heat exchanger 26*d*, the first heat medium flow control device 25*c* or the first heat medium flow control device 25*d* may be opened so as to allow the heat medium to circulate.

[Cooling-Main Operation Mode]

Figure 5:
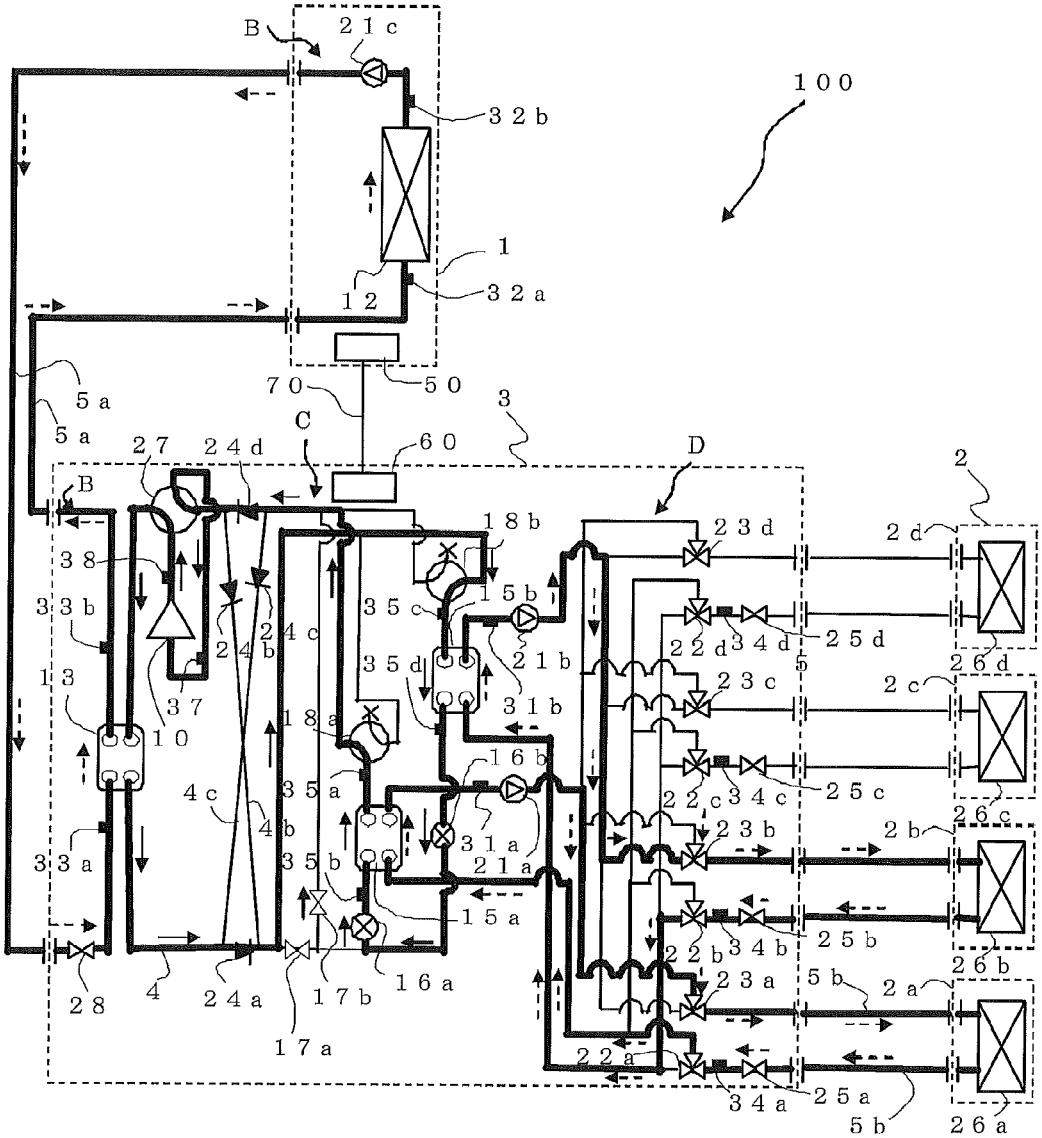
FIG. 5 is a circuit diagram showing the flow of the refrigerant and the heat medium in the air-conditioning apparatus according to Embodiment 1 of the present invention, in a cooling-main operation.

FIG. 5 is a circuit diagram showing the flow of the refrigerant and the heat medium in the air-conditioning apparatus 100 according to Embodiment 1 of the present invention, in the cooling-main operation. Referring to FIG. 5, the cooling-main operation mode will be described on the assumption that the cooling load has arisen in the use side heat exchanger 26*a* and the heating load has arisen in the use side heat exchanger 26*b*. In FIG. 5, the pipes illustrated in bold lines represent the pipes in which the refrigerant and the heat medium flow. In addition, the flow of the refrigerant is indicated by solid arrows and the flow of the heat medium is indicated by broken-line arrows.

In the cooling-main operation mode shown in FIG. 5, the pump 21*c* in the outdoor unit 1 is driven, so as to circulate the second heat medium. In the relay unit 3, the first refrigerant flow switching device 27 is switched so as to cause the refrigerant discharged from the compressor 10 to flow into the second intermediate heat exchanger 13, and the pump 21*a* and the pump 21*b* are activated. The first heat medium flow control device 25*a* and the first heat medium flow control device 25*b* are fully opened, while the first heat medium flow control device 25*c* and the first heat medium flow control device 25*d* are fully closed, so as to allow the heat medium to circulate between each of the first intermediate heat exchanger 15*a* and the first intermediate heat exchanger 15*b* and each of the use-side heat exchanger 26*a* and the use-side heat exchanger 26*b*.

First, the flow of the second heat medium from the outdoor unit 1 to the relay unit 3 in the second heat medium circuit B will be described.

In the cooling-main operation mode, the heating energy of the second heat medium is transferred to the outdoor space in the outdoor-side heat exchanger 12, and the pump 21*c* causes the cooled second heat medium to flow through the heat medium pipe 5*a*. The second heat medium pressurized by the pump 21*c* and discharged therefrom flows out of the outdoor unit 1 and flows into the relay unit 3 through the heat medium pipe 5*a*, and then flows into the second intermediate heat exchanger 13 through the second heat medium flow control device 28. In the second intermediate heat exchanger 13, the cooling energy of the second heat medium is transferred to the first refrigerant, after which the second heat medium flows out of the relay unit 3 and flows into the outdoor unit 1 through the heat medium pipe 5*a*, and then again flows into the outdoor-side heat exchanger 12.

In this process, the heat medium flow control device 28 controls the opening degree so as to bring the pressure on the high pressure-side in the first refrigerant circuit C to be subsequently described close to a target pressure, to control the flow rate of the second heat medium flowing in the second intermediate heat exchanger. Then the rotation speed of the pump 21*c* is controlled so that the opening degree of the heat medium flow control device 28 thus controlled becomes as close as possible to full-open. More specifically, when the opening degree of the heat medium flow control device 28 is considerably smaller than full-open, the rotation speed of the pump 21*c* is reduced. When the opening degree of the heat medium flow control device 28 is close to full-open, the pump 21*c* is controlled so as to maintain the same flow rate of the second heat medium. It is not mandatory that the heat medium flow control device 28 is fully opened, but it suffices that the heat medium flow control device 28 is opened to a substantially high degree, such as 90% or 85% of the fully opened state. In this case, the controller 60 controlling the opening degree of the heat medium flow control device 28 is located inside or close to the relay unit 3, and the controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the heat medium flow control device 28 to the controller 50 of the outdoor unit 1 through wired or wireless communication line connecting between the relay unit 3 and the outdoor unit 1, to thereby perform a linkage control described as above. The controller 50 of the outdoor unit 1 also controls the non-illustrated fan provided for the outdoor-side heat exchanger 12.

Hereunder, the flow of the first refrigerant in the first refrigerant circuit C in the relay unit 3 will be described.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 flows into the second intermediate heat exchanger 13 acting as a first condenser, through the first refrigerant flow switching device 27, and is condensed while transferring heat to the second heat medium in the second intermediate heat exchanger 13, thereby turning into high-pressure two-phase refrigerant. In this process the flow path is formed so that the second heat medium and the first refrigerant flow in opposite directions to each other in the second intermediate heat exchanger 13. The high-pressure two-phase refrigerant which has flowed out of the second intermediate heat exchanger 13 flows into the first intermediate heat exchanger 15*b* acting as a second condenser through the check valve 24*a* and the second refrigerant flow switching device 18*b*. The high-pressure two-phase refrigerant which has entered the first intermediate heat exchanger 15*b* is condensed and liquefied while transferring heat to the first heat medium circulating in the first heat medium circuit D, thereby turning into liquid refrigerant. In this process the flow path is formed so that the first refrigerant and the first heat medium flow in opposite directions to each other in the first intermediate heat exchanger 15*b*. The liquid refrigerant which has flowed out of the first intermediate heat exchanger 15*b* is expanded in the first expansion device 16*b* thus to turn into low-pressure two-phase refrigerant, and flows into the first intermediate heat exchanger 15*a* acting as an evaporator, through the first expansion device 16*a*.

The low-pressure two-phase refrigerant which has entered the first intermediate heat exchanger 15*a* removes heat from the first heat medium circulating in the first heat medium circuit D thereby cooling the first heat medium and thus turning into low-pressure gas refrigerant. In this process the flow path is formed so that the first refrigerant and the first heat medium flow in parallel to each other in the first intermediate heat exchanger 15*a*.

The gas refrigerant which has flowed out of the first intermediate heat exchanger 15*a* passes through the second refrigerant flow switching device 18*a*, the check valve 24*d*, and the first refrigerant flow switching device 27, and is again sucked into the compressor 10.

In the mentioned process, the opening degree of the first expansion device 16*b* is controlled so as to keep a degree of superheating at a constant level, the degree of superheating representing a difference between the temperature detected by the intermediate heat exchanger refrigerant temperature sensor 35*a* and the temperature detected by the intermediate heat exchanger refrigerant temperature sensor 35*d*. Here, the first expansion device 16*a* is fully opened, the open/close device 17*a* is closed, and the open/close device 17*b* is closed. Alternatively, the opening degree of the first expansion device 16*b* may be controlled so as to keep a degree of subcooling at a constant level, the degree of subcooling representing a difference between a saturation temperature converted from the pressure detected by the high-pressure refrigerant pressure sensor 38 and the temperature detected by the intermediate heat exchanger refrigerant temperature sensor 35*d*. Further, the first expansion device 16*b* may be fully opened and the first expansion device 16*a* may be used to control the superheating or subcooling.

The frequency of the compressor 10 and the opening degree of the second heat medium flow control device 28 are controlled so that the pressure (low pressure) of the first refrigerant detected by the low-pressure refrigerant pressure sensor 37 and the pressure (high pressure) of the first refrigerant detected by the high-pressure refrigerant pressure sensor 38 match the respective target pressures. The target value may be, for example, the saturation pressure corresponding to 49 degrees Celsius on the high pressure-side, and the saturation pressure corresponding to 0 degrees Celsius on the low pressure-side. By controlling the frequency of the compressor 10 the flow rate of the first refrigerant flowing in the first intermediate heat exchanger 15 and the second intermediate heat exchanger 13 can be adjusted, and by controlling the opening degree of the second heat medium flow control device 28 the flow rate of the second heat medium flowing in the second intermediate heat exchanger 13 can be adjusted. Through such control the heat exchange amount between the refrigerant and the heat medium can be adjusted in the first intermediate heat exchanger 15*a*, the first intermediate heat exchanger 15*b*, and the second intermediate heat exchanger 13, and therefore both of the high pressure-side pressure and the low pressure-side pressure can be controlled to the respective target values.

Further, the frequency of the compressor 10 and the opening degree of the second heat medium flow control device 28 may be controlled so that the temperature detected by the intermediate heat exchanger outlet temperature sensor 31*a* and the temperature detected by the intermediate heat exchanger outlet temperature sensor 31*b* become close to the target temperature.

The flow of the first heat medium in the first heat medium circuit D will now be described.

In the cooling-main operation mode, the heating energy of the first refrigerant is transmitted to the first heat medium in the first intermediate heat exchanger 15*b*, and the heated first heat medium is driven by the pump 21*b* to flow through the pipe 5*b*. In the cooling-main operation mode, in addition, the cooling energy of the first refrigerant is transmitted to the first heat medium in the first intermediate heat exchanger 15*a*, and the cooled first heat medium is driven by the pump 21*a* to flow through the pipe 5*b*. The first heat medium pressurized by the pump 21*a* and the pump 21*b* and discharged therefrom flows into the use-side heat exchanger 26*a* and the use-side heat exchanger 26*b*, through the second heat medium flow switching device 23*a* and the second heat medium flow switching device 23*b*.

The first heat medium transfers heat to indoor air in the use-side heat exchanger 26*b*, thereby heating the indoor space 7. In contrast, the first heat medium removes heat from indoor air in the use-side heat exchanger 26*a*, thereby cooling the indoor space 7. In the mentioned process, the flow rate of the heat medium flowing into the use-side heat exchanger 26*a* and the use-side heat exchanger 26*b* is controlled by the first heat medium flow control device 25*a* and the first heat medium flow control device 25*b* so as to satisfy the air-conditioning load required in the indoor space. The heat medium with the temperature slightly lowered by passing through the use-side heat exchanger 26*b* flows into the first intermediate heat exchanger 15*b* through the first heat medium flow control device 25*b* and the first heat medium flow switching device 22*b*, and is again sucked into the pump 21*b*. The heat medium with the temperature slightly increased by passing through the use-side heat exchanger 26*a* flows into the first intermediate heat exchanger 15*a* through the first heat medium flow control device 25*a* and the first heat medium flow switching device 22*a*, and is again sucked into the pump 21*a*.

In the mentioned process, the heated heat medium and the cooled heat medium are introduced into the respective use-side heat exchangers 26 where the heating load and the cooling load are present, without being mixed with each other, under the control of the first heat medium flow switching device 22 and the second heat medium flow switching device 23. In the pipe 5*b* in the use-side heat exchanger 26, the heat medium flows in the direction from the second heat medium flow switching device 23 toward the first heat medium flow switching device 22 through the first heat medium flow control device 25, on both of the heating and cooling sides. The air-conditioning load required in the indoor space 7 can be satisfied by controlling so as to maintain at a target value the difference between the temperature detected by the intermediate heat exchanger outlet temperature sensor 31*b* and the temperature detected by the use-side heat exchanger outlet temperature sensor 34 on the heating side, and the difference between the temperature detected by the intermediate heat exchanger outlet temperature sensor 31*a* and the temperature detected by the use-side heat exchanger outlet temperature sensor 34 on the cooling side.

During the cooling-main operation mode, the flow path to the use-side heat exchanger 26 where the thermal load has not arisen (including a state where a thermostat is off) is closed by the first heat medium flow control device 25 to restrict the flow of the heat medium, since it is not necessary to supply the heat medium to such use-side heat exchanger 26. In FIG. 5, the thermal load is present in the use-side heat exchanger 26*a* and the use-side heat exchanger 26*b* and hence the heat medium is supplied thereto, however the thermal load has not arisen in the use-side heat exchanger 26*c* and the use-side heat exchanger 26*d*, and therefore the corresponding first heat medium flow control device 25*c* and first heat medium flow control device 25*d* are fully closed. When the thermal load arises in the use-side heat exchanger 26*c* or the use-side heat exchanger 26*d*, the first heat medium flow control device 25*c* or the first heat medium flow control device 25*d* may be opened so as to allow the heat medium to circulate.

[Heating-Main Operation Mode]

Figure 6:
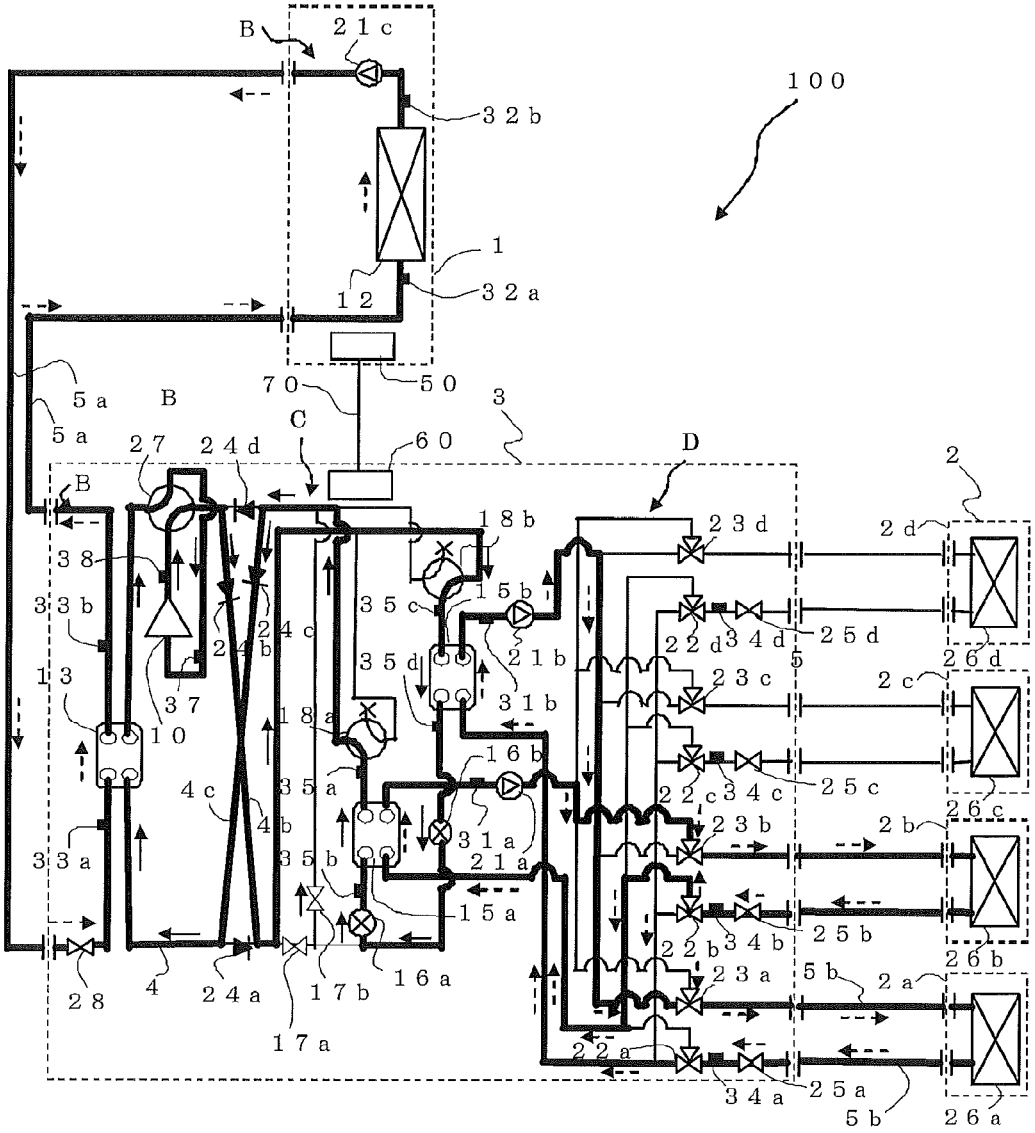
FIG. 6 is a circuit diagram showing the flow of the refrigerant and the heat medium in the air-conditioning apparatus according to Embodiment 1 of the present invention, in a heating-main operation.

FIG. 6 is a circuit diagram showing the flow of the refrigerant and the heat medium in the air-conditioning apparatus 100 according to Embodiment 1 of the present invention, in the heating-main operation. Referring to FIG. 6, the heating-main operation mode will be described on the assumption that the heating load has arisen in the use side heat exchanger 26*a* and the cooling load has arisen in the use side heat exchanger 26*b*. In FIG. 6, the pipes illustrated in bold lines represent the pipes in which the refrigerant and the heat medium flow. In addition, the flow of the refrigerant is indicated by solid arrows and the flow of the heat medium is indicated by broken-line arrows.

In the heating-main operation mode shown in FIG. 6, the pump 21*c* in the outdoor unit 1 is driven, so as to circulate the second heat medium. In the relay unit 3, the first refrigerant flow switching device 27 is switched so as to cause the refrigerant discharged from the second intermediate heat exchanger 13 to flow into the compressor 10, and the pump 21*a* and the pump 21*b* are activated. The first heat medium flow control device 25*a* and the first heat medium flow control device 25*b* are fully opened, while the first heat medium flow control device 25*c* and the first heat medium flow control device 25*d* are fully closed, so as to allow the heat medium to circulate between each of the first intermediate heat exchanger 15*a* and the first intermediate heat exchanger 15*b* and each of the use-side heat exchanger 26*a* and the use-side heat exchanger 26*b*.

First, the flow of the second heat medium from the outdoor unit 1 to the relay unit 3 in the second heat medium circuit B will be described.

In the heating-main operation mode, the second heat medium removes heat from the outdoor space 6 in the outdoor-side heat exchanger 12, and the pump 21*c* causes the heated second heat medium to flow through the heat medium pipe 5*a*. The second heat medium pressurized by the pump 21*c* and discharged therefrom flows out of the outdoor unit 1 and flows into the relay unit 3 through the heat medium pipe 5*a*, and then flows into the second intermediate heat exchanger 13 through the second heat medium flow control device 28. In the second intermediate heat exchanger 13, the heating energy of the second heat medium is transferred to the second refrigerant, after which the second heat medium flows out of the relay unit 3 and flows into the outdoor unit 1 through the heat medium pipe 5*a*, and then again flows into the outdoor-side heat exchanger 12.

In this process, the heat medium flow control device 28 controls the opening degree so as to bring the pressure on the low pressure-side in the first refrigerant circuit C to be subsequently described close to a target pressure, to control the flow rate of the second heat medium flowing in the second intermediate heat exchanger. Then the rotation speed of the pump 21*c* is controlled so that the opening degree of the heat medium flow control device 28 thus controlled becomes as close as possible to full-open. More specifically, when the opening degree of the heat medium flow control device 28 is considerably smaller than full-open, the rotation speed of the pump 21*c* is reduced. When the opening degree of the heat medium flow control device 28 is close to full-open, the pump 21*c* is controlled so as to maintain the same flow rate of the second heat medium. It is not mandatory that the heat medium flow control device 28 is fully opened, but it suffices that the heat medium flow control device 28 is opened to a substantially high degree, such as 90% or 85% of the fully opened state. In this case, the controller 60 controlling the opening degree of the heat medium flow control device 28 is located inside or close to the relay unit 3, and the controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the heat medium flow control device 28 to the controller 50 of the outdoor unit 1 through wired or wireless communication line connecting between the relay unit 3 and the outdoor unit 1, to thereby perform a linkage control described as above. The controller 50 of the outdoor unit 1 also controls the non-illustrated fan provided for the outdoor-side heat exchanger 12.

Hereunder, the flow of the first refrigerant in the first refrigerant circuit C in the relay unit 3 will be described.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 passes through the first refrigerant flow switching device 27, the check valve 24*b* and the refrigerant pipe 4*b*, and the second refrigerant flow switching device 18*b*, and then flows into the first intermediate heat exchanger 15*b* acting as a condenser. The gas refrigerant which has entered the first intermediate heat exchanger 15*b* is condensed and liquefied while transferring heat to the first heat medium circulating in the first heat medium circuit D, thereby turning into liquid refrigerant. In this process the flow path is formed so that the first heat medium and the first refrigerant flow in opposite directions to each other in the first intermediate heat exchanger 15*b*. The liquid refrigerant which has flowed out of the first intermediate heat exchanger 15*b* is expanded in the first expansion device 16*b* thus to turn into low-pressure two-phase refrigerant, and flows into the first intermediate heat exchanger 15*a* acting as an evaporator, through the first expansion device 16*a*.

The low-pressure two-phase refrigerant which has entered the first intermediate heat exchanger 15*a* is evaporated upon removing heat from the heat medium circulating in the first heat medium circuit D, thereby cooling the first heat medium. In this process the flow path is formed so that the first refrigerant and the first heat medium flow in parallel to each other in the first intermediate heat exchanger 15*a*.

The low-pressure two-phase refrigerant which has flowed out of the first intermediate heat exchanger 15*a* passes through the second refrigerant flow switching device 18*a*, the check valve 24*c*, and flows into the second intermediate heat exchanger 13 acting as an evaporator. The refrigerant which has entered the second intermediate heat exchanger 13 removes heat from the second heat medium circulating in the second heat medium circuit B thereby turning into low-temperature/low-pressure gas refrigerant, and is again sucked into the compressor 10 through the first refrigerant flow switching device 27.

In the mentioned process, the opening degree of the first expansion device 16*b* is controlled so as to keep a degree of subcooling at a constant level, the degree of subcooling representing a difference between a saturation temperature converted from the pressure detected by the high-pressure refrigerant pressure sensor 38 and the temperature detected by the intermediate heat exchanger refrigerant temperature sensor 35*d*. The first expansion device 16*a* is fully opened, the open/close device 17*a* is closed, and the open/close device 17*b* is closed. Alternatively, the first expansion device 16*b* may be fully opened and the first expansion device 16*a* may be used to control the subcooling.

The frequency of the compressor 10 and the opening degree of the second heat medium flow control device 28 are controlled so that the pressure (low pressure) of the first refrigerant detected by the low-pressure refrigerant pressure sensor 37 and the pressure (high pressure) of the first refrigerant detected by the high-pressure refrigerant pressure sensor 38 match the respective target pressures. The target value may be, for example, the saturation pressure corresponding to 49 degrees Celsius on the high pressure-side, and the saturation pressure corresponding to 0 degrees Celsius on the low pressure-side. By controlling the frequency of the compressor 10 the flow rate of the first refrigerant flowing in the first intermediate heat exchanger 15 and the second intermediate heat exchanger 13 can be adjusted, and by controlling the opening degree of the second heat medium flow control device 28 the flow rate of the second heat medium flowing in the second intermediate heat exchanger 13 can be adjusted. Through such control the heat exchange amount between the refrigerant and the heat medium can be adjusted in the first intermediate heat exchanger 15*a*, the first intermediate heat exchanger 15*b*, and the second intermediate heat exchanger 13, and therefore both of the high pressure-side pressure and the low pressure-side pressure can be controlled to the respective target values.

Further, the frequency of the compressor 10 and the opening degree of the second heat medium flow control device 28 may be controlled so that the temperature detected by the intermediate heat exchanger outlet temperature sensor 31*a* and the temperature detected by the intermediate heat exchanger outlet temperature sensor 31*b* become close to the target temperature.

The flow of the first heat medium in the first heat medium circuit D will now be described.

In the heating-main operation mode, the heating energy of the first refrigerant is transmitted to the first heat medium in the first intermediate heat exchanger 15*b*, and the heated first heat medium is driven by the pump 21*b* to flow through the pipe 5*b*. In the heating-main operation mode, in addition, the cooling energy of the first refrigerant is transmitted to the first heat medium in the first intermediate heat exchanger 15*a*, and the cooled first heat medium is driven by the pump 21*a* to flow through the pipe 5*b*. The first heat medium pressurized by the pump 21*a* and the pump 21*b* and discharged therefrom flows into the use-side heat exchanger 26*a* and the use-side heat exchanger 26*b*, through the second heat medium flow switching device 23*a* and the second heat medium flow switching device 23*b*.

The first heat medium removes heat from indoor air in the use-side heat exchanger 26*b*, thereby cooling the indoor space 7. In contrast, the first heat medium transfers heat to indoor air in the use-side heat exchanger 26*a*, thereby heating the indoor space 7. In the mentioned process, the flow rate of the heat medium flowing into the use-side heat exchanger 26*a* and the use-side heat exchanger 26*b* is controlled by the first heat medium flow control device 25*a* and the first heat medium flow control device 25*b* so as to satisfy the air-conditioning load required in the indoor space. The heat medium with the temperature slightly increased by passing through the use-side heat exchanger 26*b* flows into the first intermediate heat exchanger 15*a* through the first heat medium flow control device 25*b* and the first heat medium flow switching device 22*b*, and is again sucked into the pump 21*a*. The heat medium with the temperature slightly lowered by passing through the use-side heat exchanger 26*a* flows into the first intermediate heat exchanger 15*b* through the first heat medium flow control device 25*a* and the first heat medium flow switching device 22*a*, and is again sucked into the pump 21*b*.

In the mentioned process, the heated heat medium and the cooled heat medium are introduced into the respective use-side heat exchangers 26 where the heating load and the cooling load are present, without being mixed with each other, under the control of the first heat medium flow switching device 22 and the second heat medium flow switching device 23. In the pipe 5*b* in the use-side heat exchanger 26, the heat medium flows in the direction from the second heat medium flow switching device 23 toward the first heat medium flow switching device 22 through the first heat medium flow control device 25, on both of the heating and cooling sides. The air-conditioning load required in the indoor space 7 can be satisfied by controlling so as to maintain at a target value the difference between the temperature detected by the intermediate heat exchanger outlet temperature sensor 31*b* and the temperature detected by the use-side heat exchanger outlet temperature sensor 34 on the heating side, and the difference between the temperature detected by the intermediate heat exchanger outlet temperature sensor 31*a* and the temperature detected by the use-side heat exchanger outlet temperature sensor 34 on the cooling side.

During the heating-main operation mode, the flow path to the use-side heat exchanger 26 where the thermal load has not arisen (including a state where a thermostat is off) is closed by the first heat medium flow control device 25 to restrict the flow of the heat medium, since it is not necessary to supply the heat medium to such use-side heat exchanger 26. In FIG. 6, the thermal load is present in the use-side heat exchanger 26*a* and the use-side heat exchanger 26*b* and hence the heat medium is supplied thereto, however the thermal load has not arisen in the use-side heat exchanger 26*c* and the use-side heat exchanger 26*d*, and therefore the corresponding first heat medium flow control device 25*c* and first heat medium flow control device 25*d* are fully closed. When the thermal load arises in the use-side heat exchanger 26*c* or the use-side heat exchanger 26*d*, the first heat medium flow control device 25*c* or the first heat medium flow control device 25*d* may be opened so as to allow the heat medium to circulate.

[Heat Medium Pipe 5*a*]

As described thus far, the air-conditioning apparatus 100 according to Embodiment 1 is configured to perform a plurality of operation modes. In those operation modes, the second heat medium such as water or an antifreeze solution flows in the heat medium pipe 5*a* connecting between the outdoor unit 1 and the relay unit 3.

[Heat Medium Pipe 5*b*]

In the plurality of operation modes performed by the air-conditioning apparatus 100 according to Embodiment 1, the first heat medium such as water or an antifreeze solution flows in the heat medium pipe 5*b* connecting between the indoor unit 2 and the relay unit 3. Since the first heat medium and the second heat medium are kept from being mixed with each other, the same heat medium may be employed for both, or different heat media may be respectively employed.

In the case where the controller 50 of the outdoor unit 1 is configured to control the pump 21*c* so as to bring the difference between the temperature detected by the outdoor-side heat exchanger temperature sensor 32*b* and the temperature detected by the outdoor-side heat exchanger temperature sensor 32*a* close to a target value, bring the temperature detected by the outdoor-side heat exchanger temperature sensor 32*b* or the temperature detected by the outdoor-side heat exchanger temperature sensor 32*a* close to a target temperature, or bring the difference between the temperature detected by the outdoor-side heat exchanger temperature sensor 32*b* or the temperature detected by the outdoor-side heat exchanger temperature sensor 32*a* and the air temperature in a non-illustrated outdoor space close to a target value, the pump 21*c* and the second heat medium flow control device 28 can be controlled in linkage with each other, without the need of the communication between the controller 50 of the outdoor unit 1 and the controller 60 of the relay unit 3.

Figure 7:
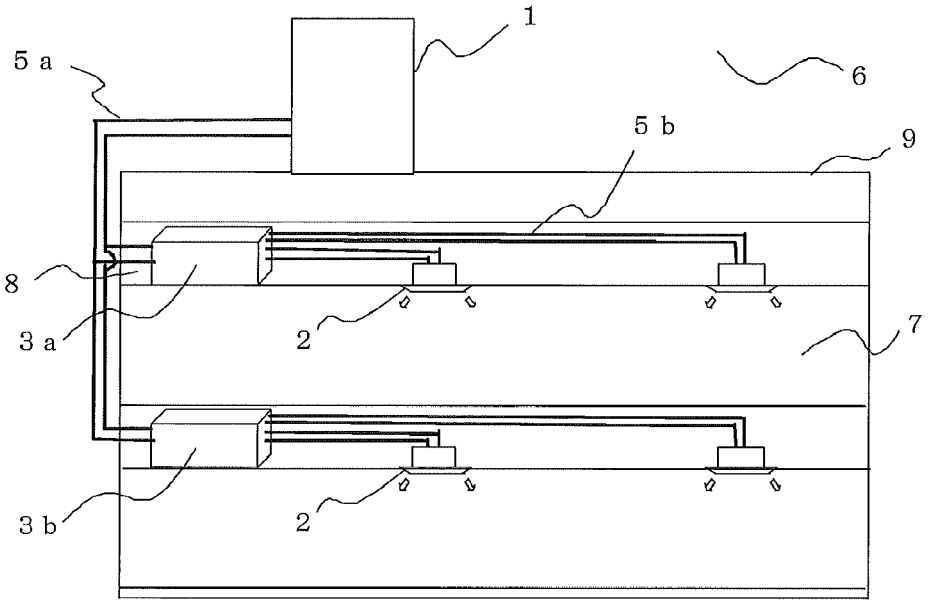
FIG. 7 is a schematic drawing showing another installation example of the air-conditioning apparatus according to Embodiment 1 of the present invention.

FIG. 7 is a schematic drawing showing another installation example of the air-conditioning apparatus according to Embodiment 1 of the present invention. In the case where a plurality of relay units 3 are installed, the heat medium pipe 5*a* connecting between the outdoor unit 1 and the relay unit 3 is branched for connection to a relay unit 3*a* and a relay unit 3*b*, and the indoor units 2 are connected to either of the relay units 3*a*, 3*b*, as shown in FIG. 7. Although a pair of relay units 3 is illustrated in FIG. 7, any desired number of relay units may be connected.

Although not shown, a plurality of outdoor units 1 may be installed, in which case the heat medium 2 flowing out of each of the outdoor units 1 may be made to jointly circulate in the heat medium pipe 5*a*, so as to flow into one or more relay units 3.

Although Embodiment 1 refers to the case where all the components of the relay unit 3 are accommodated in a single casing, the relay unit 3 may be separately disposed in a plurality of casings. Referring to FIG. 2 for example, the portion on the right of the pump 21*a* and the pump 21*b* may be accommodated in a separate casing, and the two casings of the relay unit 3 may be connected via the four pipes in which the first heat medium flows. In this case, the two casings of the relay unit 3 may be located away from each other.

Although Embodiment 1 refers to the case where the first heat medium flow switching device 22, the second heat medium flow switching device 23, and the first heat medium flow control device 25 are independent components, these devices may be configured in any desired form provided that the flow path of the heat medium can be switched and the flow rate of the heat medium can be controlled. For example, all of the first heat medium flow switching device 22, the second heat medium flow switching device 23, and the first heat medium flow control device 25 may be unified into a single device, or any two of the first heat medium flow switching device 22, the second heat medium flow switching device 23, and the first heat medium flow control device 25 may be unified.

Further, although Embodiment 1 refers to the case where the opening degree of the second heat medium flow control device 28 is controlled so as to adjust the flow rate of the heat medium flowing in the second intermediate heat exchanger 13, and the rotation speed of the pump 21*c* is controlled so as to set the second heat medium flow control device 28 close to a fully opened state, the second heat medium flow control device 28 may be excluded and the rotation speed of the pump 21*c* may be directly controlled so as to adjust the flow rate of the heat medium flowing in the second intermediate heat exchanger 13. In this case, the signal transmitted between the controller 50 and the controller 60 may be one or more of a signal indicating the temperature detected by the intermediate heat exchanger temperature sensor 33*a*, a signal indicating the temperature detected by the intermediate heat exchanger temperature sensor 33*b*, and a signal indicating the difference between the temperature detected by the intermediate heat exchanger temperature sensor 33*b* and the temperature detected by the intermediate heat exchanger temperature sensor 33*a*, instead of the opening degree of the second heat medium flow control device 28.

In the air-conditioning apparatus 100, when only the heating load or the cooling load is present in the use-side heat exchanger 26, the corresponding first heat medium flow switching device 22 and second heat medium flow switching device 23 are set to an intermediate opening degree so as to allow the heat medium to flow to both of the first intermediate heat exchanger 15*a* and the first intermediate heat exchanger 15*b*. Such an arrangement allows both of the first intermediate heat exchanger 15*a* and the first intermediate heat exchanger 15*b* to be utilized for the heating operation or the cooling operation, in which case a larger heat transmission area can be secured and therefore the heating operation or the cooling operation can be efficiently performed.

In the case where the heating load and the cooling load are present in mixture in the use-side heat exchanger 26, the first heat medium flow switching device 22 and the second heat medium flow switching device 23 corresponding to the use-side heat exchanger 26 engaged in the heating operation is switched to the flow path leading to the first intermediate heat exchanger 15*b* for heating, and the first heat medium flow switching device 22 and the second heat medium flow switching device 23 corresponding to the use-side heat exchanger 26 engaged in the cooling operation is switched to the flow path leading to the first intermediate heat exchanger 15*a* for cooling. With such an arrangement, the heating operation and the cooling operation can be freely selected with respect to each of the indoor units 2.

The first heat medium flow switching device 22 and the second heat medium flow switching device 23 according to Embodiment 1 may be configured in any desired form provided that the flow path can be switched, for example the three-way valve capable of switching the flow path in three ways, or a combination of two on/off valves each configured to open and close a two-way flow path. Alternatively, a device capable of varying the flow rate in a three-way flow path, such as a mixing valve driven by a stepping motor, or a combination of two devices each capable of varying the flow rate in a two-way flow path, such as electronic expansion valves may be employed, in place of the first heat medium flow switching device 22 and the second heat medium flow switching device 23. Such a configuration prevents a water hammer originating from sudden shutting of the flow path. Further, although the first heat medium flow control device 25 is constituted of a two-way valve in Embodiment 1, the first heat medium flow control device 25 may be a three-way control valve used in combination with a bypass pipe circumventing the use-side heat exchanger 26.

It is preferable that the first heat medium flow control device 25 and the second heat medium flow control device 28 are driven by a stepping motor so as to control the flow rate of the heat medium in the flow path, in which case a two-way valve or a three-way valve having one way closed may be employed. Alternatively, the first heat medium flow control device 25 may be constituted of an on/off valve that opens and closes a two-way flow path, for controlling the flow rate as an average value by repeating the on/off operation.

Although the second refrigerant flow switching device 18 is illustrated as a four-way valve, a plurality of two-way flow switching valves or three-way flow switching valves may be employed so as to allow the refrigerant to flow in the same manner.

It is a matter of course that the same effects can be attained even in the case where just one each of the use-side heat exchanger 26 and the first heat medium flow control valve 25 are provided, and a plurality of first intermediate heat exchangers 15 and expansion devices 16, each configured to work in the same way, may naturally be employed. Further, although the first heat medium flow control valve 25 is incorporated in the relay unit 3 in Embodiment 1, the first heat medium flow control valve 25 may be incorporated in the indoor unit 2, or independently disposed from the relay unit 3 and the indoor unit 2.

The relay unit 3 is normally installed inside the building in the air-conditioning apparatus according to the present invention, and hence the first refrigerant employed in the first refrigerant circuit C of the relay unit 3 is located in the space not to be air-conditioned 8 inside the building. Accordingly, it is preferable to employ a non-flammable refrigerant such as R-22, HFO-134a, R-410A, R-404A, or R-407C as the first refrigerant, from the viewpoint of safety. Alternatively, the first refrigerant may be low-flammable refrigerant (classified as A2L according to American Society of Heating, Refrigerating and Air-Conditioning Engineers (ASHRAE), which is refrigerant with a burning rate not higher than 10 cm/s among those classified as A2) such as HFO-1234yf, HFO-1234ze(E), or R32, and further refrigerant used in a high pressure supercritical state such as $CO_2$, highly flammable refrigerant such as propane (R290), or other types of refrigerants may be employed. When the first intermediate heat exchanger 15*a* or the first intermediate heat exchanger 15*b* is set to work as a condenser, refrigerant that shifts between two phases is condensed and liquefied, and refrigerant used in a supercritical state such as $CO_2$ is cooled in the supercritical state, and in either of the mentioned cases the same effects are attained.

In the case of employing a flammable refrigerant in the air-conditioning apparatus, the upper limit of the amount of the refrigerant loaded in the refrigerant circuit is stipulated by law according to the volume of the space (room) in which the air-conditioning apparatus is installed. When the refrigerant concentration in the air exceeds a lower flammable limit (LFL) and an ignition source is present, the refrigerant catches fire. According to ASHRAE, when the amount of a flammable refrigerant is not larger than four times of LFL there is no limitation of the volume of the space where the apparatus is to be installed, in other words the apparatus may be installed in a space of any size. Further, when refrigerant classified as low-flammable refrigerant (A2L refrigerant) among the flammable refrigerants, such as R32, HFO-1234yf, or HFO-1234ze (E) is employed, there is no limitation of the volume of the space where the apparatus is to be installed and the apparatus may be installed in a space of any size, provided that the amount of refrigerant loaded in the apparatus is not larger than 150% of four times of LFL. LFL of R-32 is 0.306 (kg/m$^3$) and LFL of HFO-1234yf is 0.289 (kg/m$^3$), and upon multiplying the LFL by 4×1.5 the amount of 1.836 (kg) is obtained for R-32 and 1.734 (kg) for HFO-1234yf. Accordingly, when the amount of refrigerant is not larger than the amount calculated above, no limitation is imposed on the installation location of the apparatus. In the air-conditioning apparatus according to the present invention, it is only the relay unit 3 that contains the refrigerant and is located inside the building. Therefore, it is preferable to load an amount not exceeding 1.8 (kg) of R-32 or 1.7 (kg) of HFO-1234yf in the refrigerant circuit C of the relay unit 3. In the case of employing a mixture of R-32 and HFO-1234yf, an amount of refrigerant not exceeding the limit calculated according to the mixture ratio may be loaded. With such amounts of the refrigerant, the relay unit 3 is free from limitation of the installation location and may be installed at any desired location. To reduce the amount of refrigerant to be loaded in the refrigerant circuit, the capacity of the apparatus has to be reduced. Accordingly, it is preferable that the compressor 10 provided in the relay unit 3 has a capacity (cooling capacity) that matches the refrigerant amount of, for example, 1.8 (kg) of R-32 or 1.7 (kg) of HFO-1234yf. In the case where the air-conditioning load required by the building is larger than the capacity (calorific capacity of cooling and heating) of the relay unit 3 determined as above, a plurality of relay units 3 may be connected to one outdoor unit 1 as shown in FIG. 7.

In general, the flammable refrigerants have a low global warming potential (GWP). For example, GWP of propane (R-290) which is highly flammable refrigerant (A3 according to ISO and ASHRAE) is 6, and GWP of HFO-1234yf which is low-flammable refrigerant (A2L according to ASHRAE) is 4, and GWP of HFO-1234ze (E) is 6. In the air-conditioning apparatus according to the present invention, the relay unit 3 loaded with the refrigerant in installed in the space not to be air-conditioned inside the building, and hence it is preferable to employ low-flammable refrigerant having a low GWP (for example, not higher than 50), such as HFO-1234yf or HFO-1234ze (E) as the first refrigerant loaded in the first refrigerant circuit C of the relay unit 3, from the viewpoint of higher safety of the air-conditioning apparatus and smaller impact on the global warming.

LFL of propane (R-290), which is highly flammable refrigerant (A3 according to ISO and ASHRAE), is 0.038 (kg/m$^3$), and therefore in the case of employing propane as the first refrigerant it is preferable to load an amount not exceeding 0.152 (kg), which is four times of LFL, in the first refrigerant circuit C because the installation location is not limited and safety in use can be secured.

The first heat medium and the second heat medium may be the same material or materials different from each other. For example, brine (antifreeze solution), water, a mixture of water and brine, and a mixture of water and an anti-corrosive additive may be employed as the heat medium. In the air-conditioning apparatus 100, therefore, even though the first heat medium leaks into the indoor space 7 through the indoor unit 2, a high level of safety can be secured since the heat medium having high safety is employed. In addition, since the heat medium, not the refrigerant, circulates between the outdoor unit 1 and the relay unit 3, the amount of refrigerant used in the system as a whole can be reduced, and therefore a high level of safety can be secured even when a flammable refrigerant is employed as the first refrigerant.

The air-conditioning apparatus according to Embodiment 1 includes the outdoor unit 1 and the relay unit 3, which are connected via the heat medium pipe. However, in the case where the building in which the air-conditioning apparatus is to be installed is equipped with a water supply source, but a suitable location for installing the outdoor unit 1 is unavailable or it is difficult to route the heat medium pipe between the outdoor unit 1 and the relay unit 3, the water supply source may be directly connected to the relay unit 3 instead of installing the outdoor unit 1, so as to utilize water as a second heat medium. In this case, however, the temperature of the second heat medium flowing in the second intermediate heat exchanger 13 is determined by the water source and is hence the temperature of the second heat medium is unable to control. Accordingly, when the temperature of the water source fluctuates the high pressure and the low pressure of the first refrigerant circuit C fluctuate, and therefore the performance of the air-conditioning apparatus becomes slightly unstable compared with the case of installing the outdoor unit 1. Even in such a case, it is possible to cool or heat the air in the space to be air-conditioned, by utilizing the first refrigerant circuit C and the first heat medium circuit D. In addition, when a cooling tower is provided in the outdoor space 6 for use as a heat removal and heat radiation unit, the second heat medium may be circulated between the relay unit 3 and the cooling tower, to thereby remove heat from and transfer heat to the second heat medium in the cooling tower.

In general, the outdoor-side heat exchanger 12 and the use-side heat exchangers 26*a* to 26*d* are each provided with a fan for higher efficiency in heat transmission between the heat medium and air. Alternatively, for example a radiation type panel heater may be employed as the use-side heat exchangers 26*a* to 26*d*, and a water-cooled device that transmits heat with water or an antifreeze solution may be employed as the outdoor-side heat exchanger 12. Thus, any device may be employed provided that the device is capable of transferring heat or removing heat.

Although the compressor 10 in the first refrigerant circuit C of the relay unit 3 is without an accumulator on the suction side, an accumulator may be provided.

Four of the use-side heat exchangers 26*a* to 26*d* are provided in Embodiment 1, however any desired number of use-side heat exchangers may be connected.

Although two heat exchangers, namely the first intermediate heat exchanger 15*a* and the first intermediate heat exchanger 15*b* are provided, naturally any desired number of such heat exchangers may be provided, as long as the heat medium can be cooled or heated.

The pump 21*a*, the pump 21*b*, and the pump 21*c* may each be constituted of a plurality of pumps of a smaller capacity connected in parallel.

Embodiment 2

Figure 8:
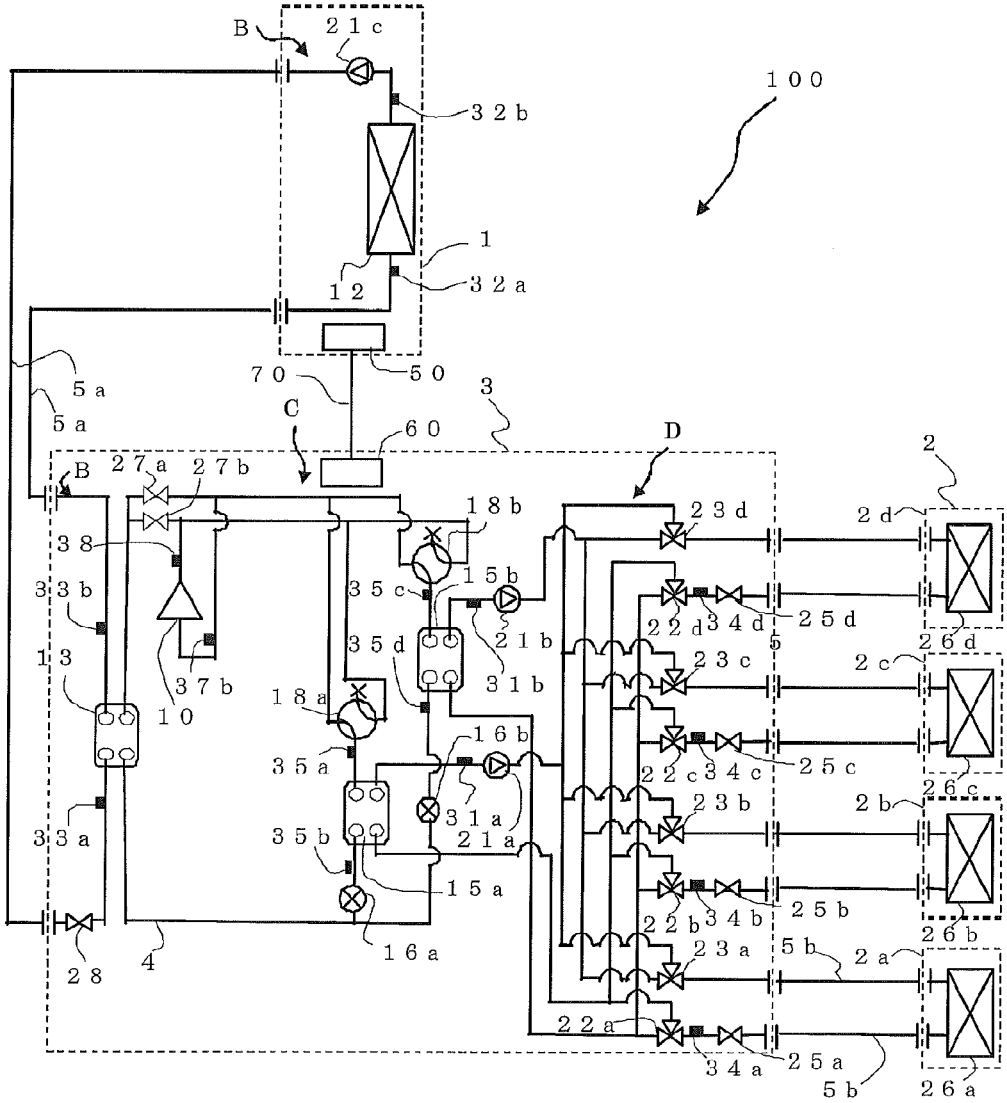
FIG. 8 is a schematic diagram showing a configuration of an air-conditioning apparatus according to Embodiment 2 of the present invention.

FIG. 8 is a schematic diagram showing a configuration of an air-conditioning apparatus according to Embodiment 2 of the present invention. In FIG. 8, the configuration of the first refrigerant circuit C of the relay unit 3 is slightly different from FIG. 2. Specifically, the first refrigerant flow switching device 27 is substituted with a first refrigerant flow switching device 27*a* and a first refrigerant flow switching device 27*b*. In addition, the pipe on the discharge side of the compressor 10 is branched into a pipe leading to the second refrigerant flow switching device 18 and a pipe leading to the second intermediate heat exchanger 13, and the refrigerant circuit on the left and the refrigerant circuit on the right in FIG. 8 are connected to each other via three pipes. The description of Embodiment 2 will be focused on differences from Embodiment 1. Although the first refrigerant flow switching device 27*a* and the first refrigerant flow switching device 27*b* are assumed to be an on/off valve for opening and closing the flow path such as an electronic valve or a two-way valve, any device may be employed provided that the flow path can be opened and closed. Alternatively, the first refrigerant flow switching device 27*a* and the first refrigerant flow switching device 27*b* may be formed as a unified body, so as to switch the flow path at the same time.

The operation modes that the air-conditioning apparatus 100 is configured to perform include the cooling-only operation mode in which all of the indoor units 2 in operation perform the cooling operation, the heating-only operation mode in which all of the indoor units 2 in operation perform the heating operation, the cooling-main operation mode in which the cooling load is greater, and the heating-main operation mode in which the heating load is greater. Hereunder, the flow of the first refrigerant in the first refrigerant circuit C will be described, with respect to each of the operation modes. The working of the devices and the flow of the heat medium in the second heat medium circuit B and the first heat medium circuit D are the same as those of Embodiment 1.

[Cooling-Only Operation Mode]

Figure 9:
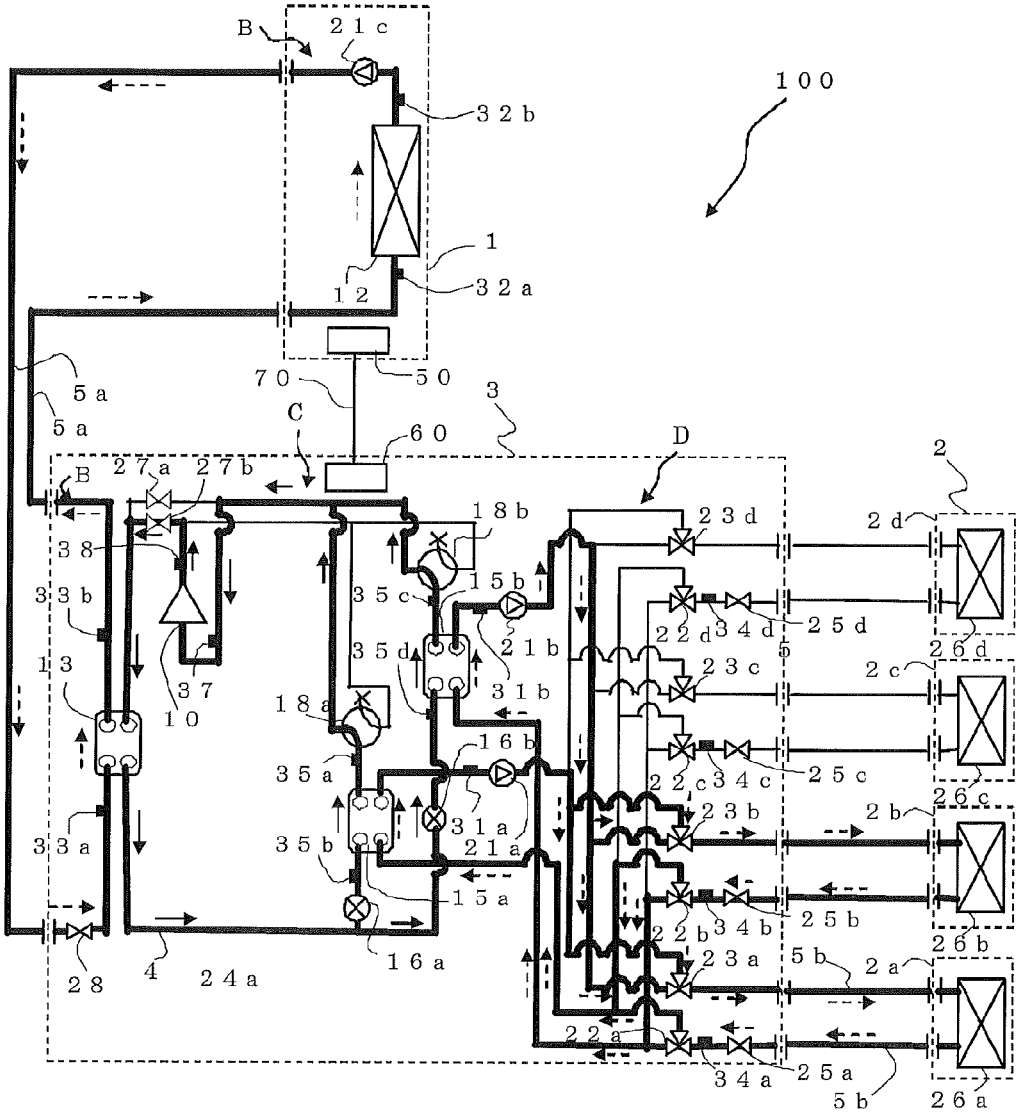
FIG. 9 is a circuit diagram showing the flow of the refrigerant and the heat medium in the air-conditioning apparatus according to Embodiment 2 of the present invention, in a cooling-only operation.

FIG. 9 is a circuit diagram showing the flow of the refrigerant and the heat medium in the air-conditioning apparatus 100, in the cooling-only operation. In FIG. 9, the pipes illustrated in bold lines represent the pipes in which the refrigerant and the heat medium flow. In addition, the flow of the refrigerant is indicated by solid arrows and the flow of the heat medium is indicated by broken-line arrows.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 flows into the second intermediate heat exchanger 13 acting as a condenser, through the first refrigerant flow switching device 27*b*, and is condensed and liquefied while transferring heat to the second heat medium in the second intermediate heat exchanger 13, thereby turning into high-pressure liquid refrigerant. In this process the flow path is formed so that the second heat medium and the first refrigerant flow in opposite directions to each other in the second intermediate heat exchanger 13. The high-pressure liquid refrigerant which has flowed out of the second intermediate heat exchanger 13 is branched and expanded in the first expansion device 16*a* and the first expansion device 16*b* thus to turn into low-temperature/low-pressure two-phase refrigerant. The two-phase refrigerant flows into each of the first intermediate heat exchanger 15*a* and the first intermediate heat exchanger 15*b* acting as an evaporator, and cools the first heat medium circulating in the first heat medium circuit D by removing heat from the first heat medium, thereby turning into low-temperature/low-pressure gas refrigerant. In this process the flow path is formed so that the first refrigerant and the first heat medium flow parallel to each other in the first intermediate heat exchanger 15*a* and the first intermediate heat exchanger 15*b*. The gas refrigerant which has flowed out of the first intermediate heat exchanger 15*a* and the first intermediate heat exchanger 15*b* is again sucked into the compressor 10 through the second refrigerant flow switching device 18*a* and the second refrigerant flow switching device 18*b*. At this point, the first refrigerant flow switching device 27*a* is closed and the first refrigerant flow switching device 27*b* is opened.

[Heating-Only Operation Mode]

Figure 10:
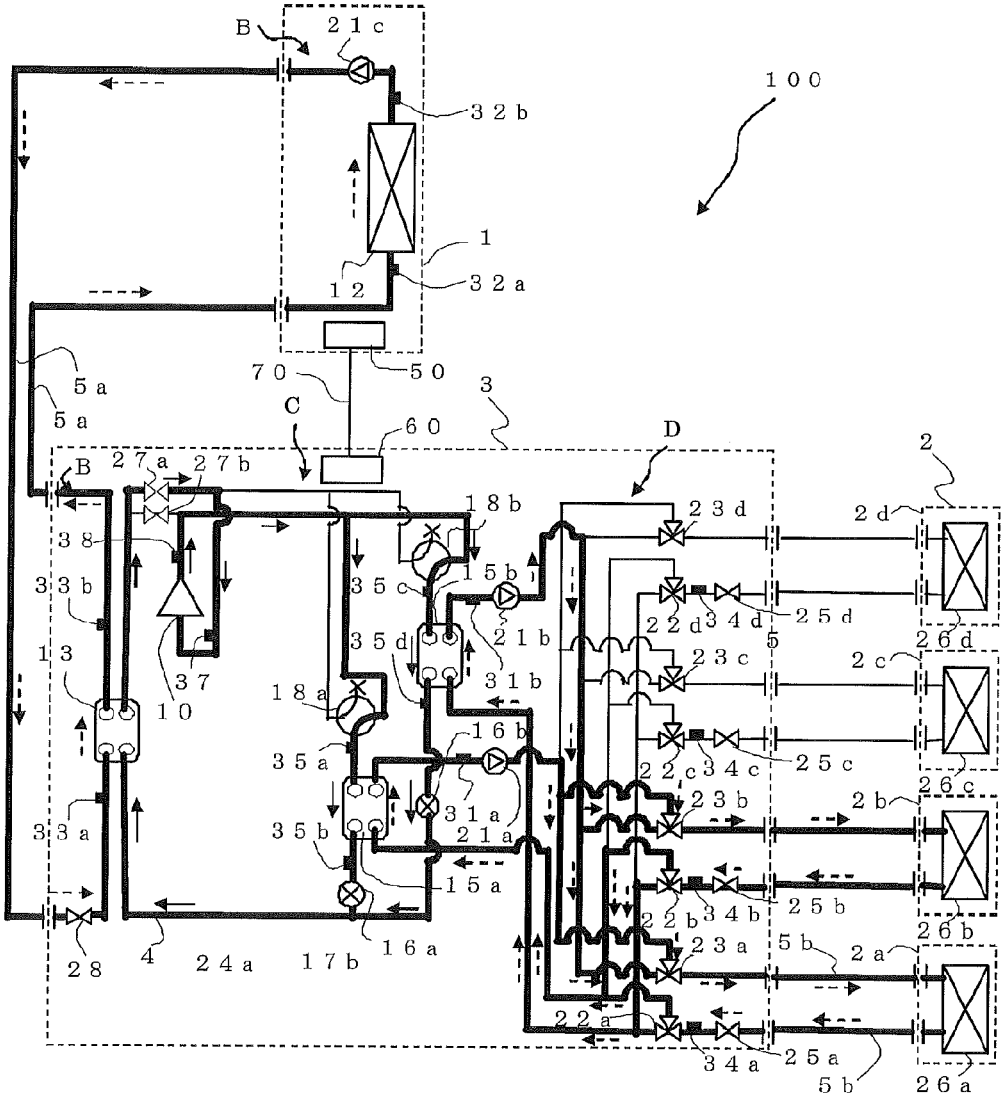
FIG. 10 is a circuit diagram showing the flow of the refrigerant and the heat medium in the air-conditioning apparatus according to Embodiment 2 of the present invention, in a heating-only operation.

FIG. 10 is a circuit diagram showing the flow of the refrigerant and the heat medium in the air-conditioning apparatus 100, in the heating-only operation. In FIG. 10, the pipes illustrated in bold lines represent the pipes in which the refrigerant and the heat medium flow. In addition, the flow of the refrigerant is indicated by solid arrows and the flow of the heat medium is indicated by broken-line arrows.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 is branched and flows into the first intermediate heat exchanger 15*a* and the first intermediate heat exchanger 15*b* acting as a condenser, through the second refrigerant flow switching device 18*a* and the second refrigerant flow switching device 18*b*. The high-temperature/high-pressure gas refrigerant which has entered the first intermediate heat exchanger 15*a* and the first intermediate heat exchanger 15*b* is condensed and liquefied while transferring heat to the first heat medium circulating in the first heat medium circuit D, thereby turning into high-pressure liquid refrigerant. In this process the flow path is formed so that the first heat medium and the first refrigerant flow in opposite directions to each other in the first intermediate heat exchanger 15*a* and the first intermediate heat exchanger 15*b*. The liquid refrigerant which has flowed out of the first intermediate heat exchanger 15*a* and the first intermediate heat exchanger 15*b* is expanded in the first expansion device 16*a* and the first expansion device 16*b* thus to turn into low-temperature/low-pressure two-phase refrigerant, and flows into the second intermediate heat exchanger 13 acting as an evaporator. The refrigerant which has entered the second intermediate heat exchanger 13 removes heat from the second heat medium flowing in the second heat medium circuit B, thereby turning into low-temperature/low-pressure gas refrigerant, and is again sucked into the compressor 10 through the first refrigerant flow switching device 27*a*. In this process the flow path is formed so that the first refrigerant and the second heat medium flow parallel to each other in the second intermediate heat exchanger 13. At this point, the first refrigerant flow switching device 27*a* is opened and the first refrigerant flow switching device 27*b* is closed.

[Cooling-Main Operation Mode]

Figure 11:
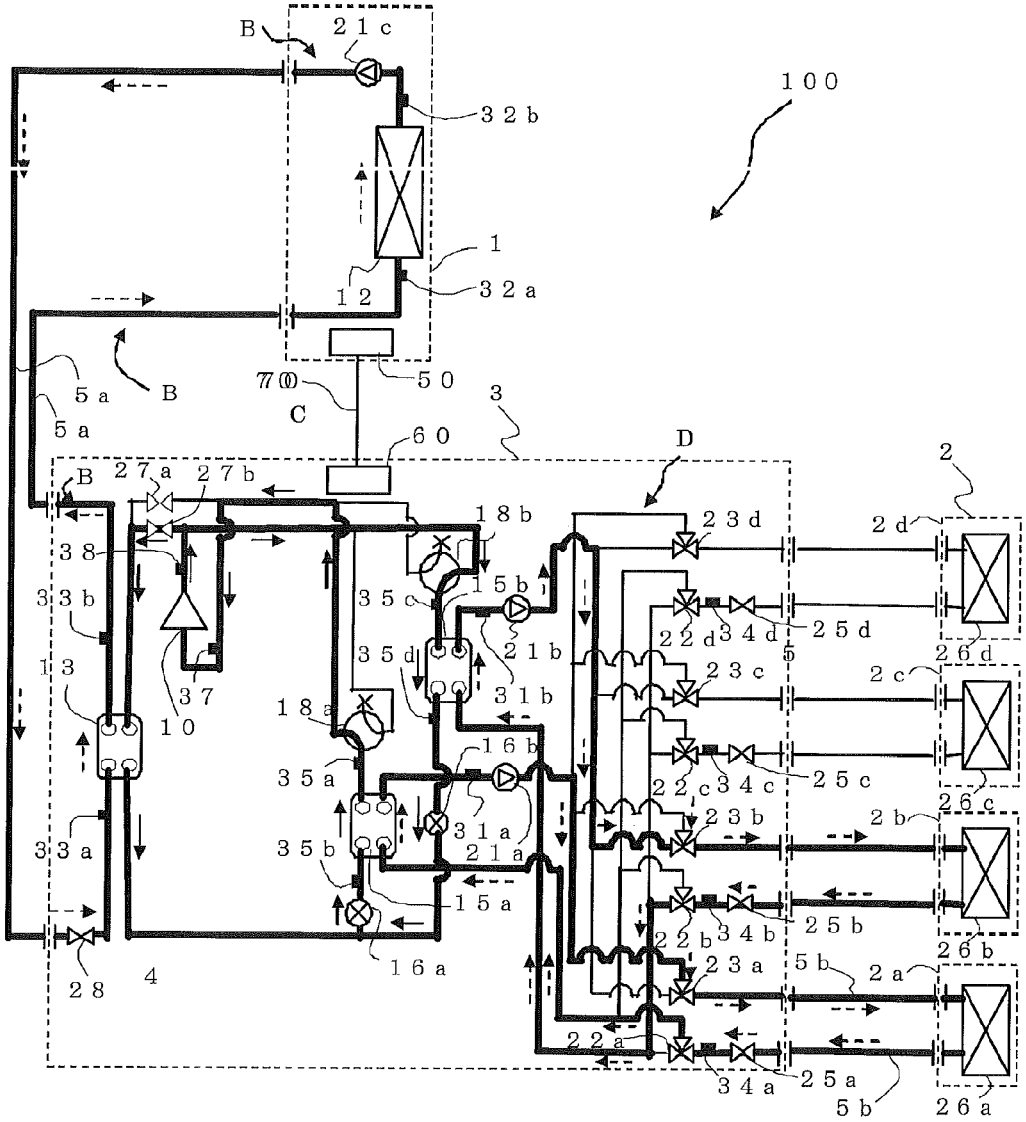
FIG. 11 is a circuit diagram showing the flow of the refrigerant and the heat medium in the air-conditioning apparatus according to Embodiment 2 of the present invention, in a cooling-main operation.

FIG. 11 is a circuit diagram showing the flow of the refrigerant and the heat medium in the air-conditioning apparatus 100, in the cooling-main operation. In FIG. 11, the pipes illustrated in bold lines represent the pipes in which the refrigerant and the heat medium flow. In addition, the flow of the refrigerant is indicated by solid arrows and the flow of the heat medium is indicated by broken-line arrows.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 is branched into the refrigerant flowing into the second intermediate heat exchanger 13 acting as a first condenser through the first refrigerant flow switching device 27*b* and the refrigerant flowing into the first intermediate heat exchanger 15*b* acting as a second condenser through the second refrigerant flow switching device 18*b*. The refrigerant that has entered the second intermediate heat exchanger 13 acting as the first condenser through the first refrigerant flow switching device 27*b* is condensed while transferring heat to the second heat medium in the second intermediate heat exchanger 13, thereby turning into high-pressure refrigerant. In this process the flow path is formed so that the second heat medium and the first refrigerant flow in opposite directions to each other in the second intermediate heat exchanger 13. The high-pressure two-phase gas refrigerant branched on the discharge side of the compressor 10 and introduced into the first intermediate heat exchanger 15*b* acting as the second condenser through the second refrigerant flow switching device 18*b* is condensed and liquefied while transferring heat to the first heat medium circulating in the first heat medium circuit D, thereby turning into liquid refrigerant. In this process the flow path is formed so that the first refrigerant and the first heat medium flow in opposite directions to each other in the first intermediate heat exchanger 15*b*. The liquid refrigerant that has flowed out of the first intermediate heat exchanger 15*b* passes through the fully opened first expansion device 16*b* and joins with the high-pressure liquid refrigerant that has flowed out of the second intermediate heat exchanger 13, and is then narrowed down in the first expansion device 16*a* thus to turn into low-pressure two-phase refrigerant, and flows into the first intermediate heat exchanger 15*a* acting as an evaporator. The low-pressure two-phase refrigerant which has entered the first intermediate heat exchanger 15*a* cools the first heat medium circulating in the first heat medium circuit D by removing heat from the first heat medium, thereby turning into low-pressure gas refrigerant. In this process the flow path is formed so that the first refrigerant and the first heat medium flow parallel to each other in the first intermediate heat exchanger 15*a*. The gas refrigerant which has flowed out of the first intermediate heat exchanger 15*a* is again sucked into the compressor 10 through the second refrigerant flow switching device 18*a*. At this point, the first refrigerant flow switching device 27*a* is closed, the first refrigerant flow switching device 27*b* is opened. The first expansion device 16*b* is fully opened, and the opening degree of the first expansion device 16*a* is controlled so as to keep a degree of superheating at a constant level, the degree of superheating representing a difference between the temperature detected by the intermediate heat exchanger refrigerant temperature sensor 35*a* and the temperature detected by the intermediate heat exchanger refrigerant temperature sensor 35*b*. Alternatively, the opening degree of the first expansion device 16*a* may be controlled so as to keep a degree of subcooling at a constant level, the degree of subcooling representing a difference between a saturation temperature converted from the pressure detected by the high-pressure refrigerant pressure sensor 38 and the temperature detected by the intermediate heat exchanger refrigerant temperature sensor 35*d*.

[Heating-Main Operation Mode]

Figure 12:
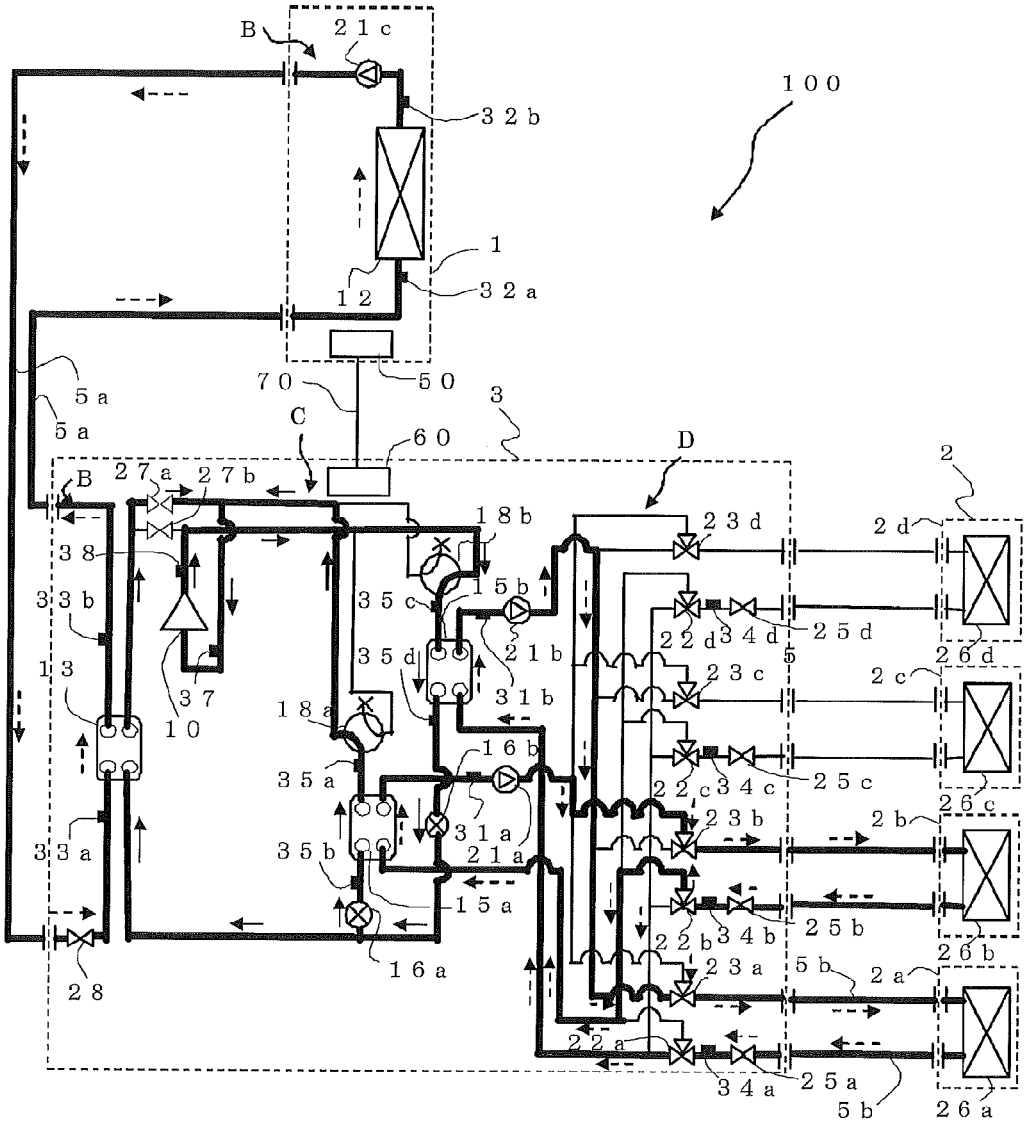
FIG. 12 is a circuit diagram showing the flow of the refrigerant and the heat medium in the air-conditioning apparatus according to Embodiment 2 of the present invention, in a heating-main operation.

FIG. 12 is a circuit diagram showing the flow of the refrigerant and the heat medium in the air-conditioning apparatus 100, in the heating-main operation. In FIG. 12, the pipes illustrated in bold lines represent the pipes in which the refrigerant and the heat medium flow. In addition, the flow of the refrigerant is indicated by solid arrows and the flow of the heat medium is indicated by broken-line arrows.

The first refrigerant in a low-temperature/low-pressure state is compressed by the compressor 10 and discharged therefrom in the form of high-temperature/high-pressure gas refrigerant. The high-temperature/high-pressure gas refrigerant discharged from the compressor 10 flows into the first intermediate heat exchanger 15*b* acting as a condenser, through the second refrigerant flow switching device 18*b*. The gas refrigerant which has entered the first intermediate heat exchanger 15*b* is condensed and liquefied while transferring heat to the first heat medium circulating in the first heat medium circuit D, thereby turning into liquid refrigerant. In this process the flow path is formed so that the first heat medium and the first refrigerant flow in opposite directions to each other in the first intermediate heat exchanger 15*b*. The liquid refrigerant which has flowed out of the first intermediate heat exchanger 15*b* is expanded in the first expansion device 16*b* thus to turn into low-pressure two-phase refrigerant, and then branched into the refrigerant flowing into the first intermediate heat exchanger 15*a* acting as an evaporator through the fully opened first expansion device 16*a* and the refrigerant flowing into the second intermediate heat exchanger 13 acting as an evaporator. The low-pressure two-phase refrigerant that has entered the first intermediate heat exchanger 15*a* acting as the evaporator through the fully opened first expansion device 16*a* is evaporated upon removing heat from the heat medium circulating in the first heat medium circuit D, thereby cooling the first heat medium and turning into low-temperature/low-pressure gas refrigerant, and the refrigerant that has entered the second intermediate heat exchanger 13 removes heat from the second heat medium circulating in the second heat medium circuit B, thereby turning into low-temperature/low-pressure gas refrigerant. Thereafter, the low-temperature/low-pressure gas refrigerant that has flowed out of the first intermediate heat exchanger 15*a* passes through the second refrigerant flow switching device 18*a* and then flows out of the second intermediate heat exchanger 13, and joins with the low-temperature/low-pressure gas refrigerant that has passed through the first refrigerant flow switching device 27*a* and is again sucked into the compressor 10. In this process the flow path is formed so that the refrigerant and the heat medium flow parallel to each other in the first intermediate heat exchanger 15*a* and in the second intermediate heat exchanger 13. At this point, the first refrigerant flow switching device 27*a* is opened, the first refrigerant flow switching device 27*b* is closed. The first expansion device 16*a* is fully opened, and the opening degree of the first expansion device 16*b* is controlled so as to keep a degree of subcooling at a constant level, the degree of subcooling representing a difference between a saturation temperature converted from the pressure detected by the high-pressure refrigerant pressure sensor 38 and the temperature detected by the intermediate heat exchanger refrigerant temperature sensor 35*d*.

With the configuration of the air-conditioning apparatus 100 according to Embodiment 2, the flow rate of the refrigerant flowing in the second intermediate heat exchanger 13 and the flow rate of the refrigerant flowing in the first intermediate heat exchanger 15*a* are unable to dynamically control, but are determined depending on the flow resistance of the pipe. Accordingly, it is preferable to provide a non-illustrated additional expansion device in the refrigerant flow path on the inlet side of the second intermediate heat exchanger 13, because in this case the flow rate of the refrigerant flowing in the second intermediate heat exchanger 13 and the flow rate of the refrigerant flowing in the first intermediate heat exchanger 15*a* can be adjusted by controlling both of the additional expansion device and the first expansion device 16*a*, and thus the intermediate heat exchanger can be more effectively utilized.

Embodiment 3

Figure 13:
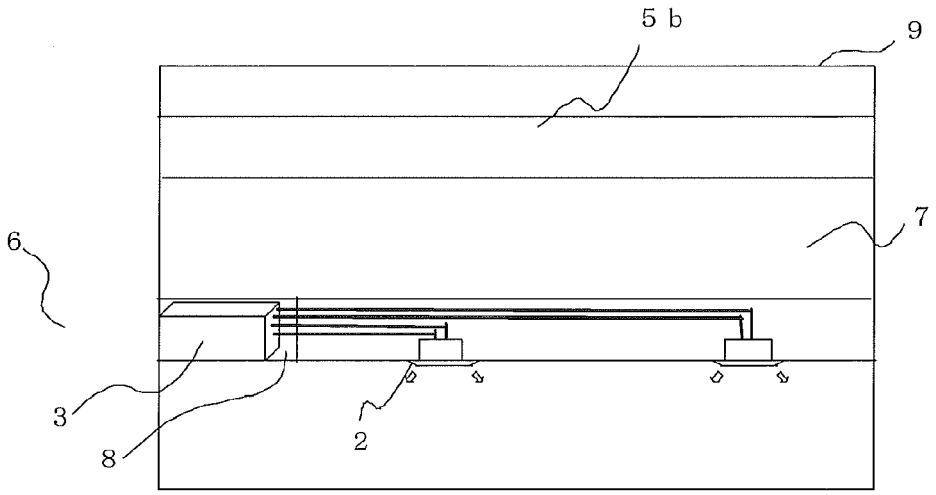
FIG. 13 is a schematic drawing showing an installation example of an air-conditioning apparatus according to Embodiment 3 of the present invention.

FIG. 13 is a schematic drawing showing an installation example of an air-conditioning apparatus according to Embodiment 3 of the present invention. In FIG. 13, the relay unit 3 is installed in the space 8 which is a recess formed inside the building 9, in other words a space where the relay unit 3 can be accommodated without protruding outward of the building 9, such as a space recessed in a rectangular shape above a door, or recess taller than wide formed in a wall at a position close to the ground. When the relay unit 3 is installed in such a space, the relay unit 3 appears to be neatly buried in the building 9 and provides good visual impression. Whereas the relay unit 3 is configured to supply air, which serves as the second heat medium, from the outer space 6 outside the building 9 to the second intermediate heat exchanger 13 located inside the relay unit 3, it suffices that the air, serving as the second heat medium, can be circulated between the outer space 6 outside the building 9 and the inside of the relay unit 3, and once the relay unit 3 is installed in the space 8 there is no need to provide a gap between the relay unit 3 and the space 8. In the case where a gap that allows air from the outdoor space 6 to intrude into the building 9 is barely formed around the relay unit 3 after the relay unit 3 is installed, it is not necessary to provide something like a partition plate that divides the space 8 from the inside of the building, as illustrated on the right of the relay unit 3 in FIG. 13, and the space 8 may be a space directly communicating with a space inside the building such as a space behind the ceiling.

Figure 14:
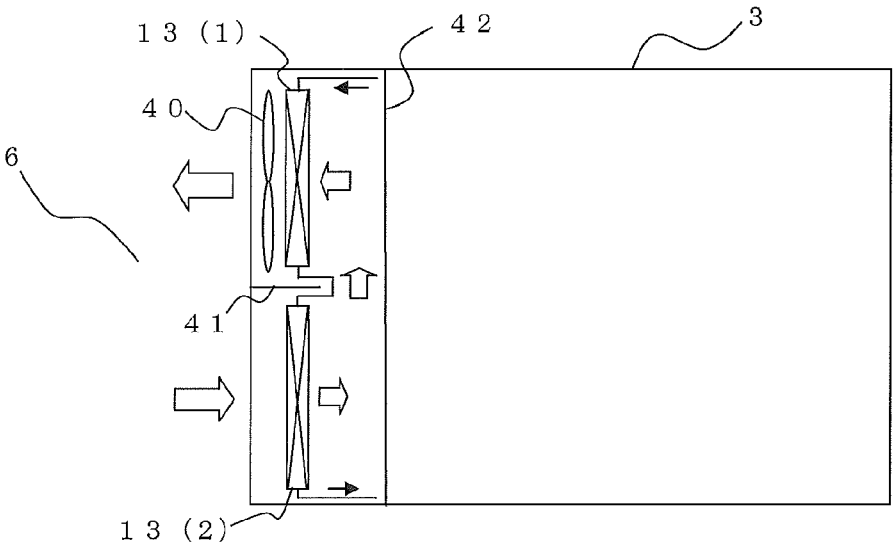
FIG. 14 is a schematic drawing showing a relay unit in the air-conditioning apparatus according to Embodiment 3 of the present invention.

FIG. 14 is a schematic drawing showing a relay unit 3 in the air-conditioning apparatus according to Embodiment 3 of the present invention. FIG. 14 illustrates the inside of the relay unit 3 viewed from an upper position in FIG. 13. Among the devices and structures provided in the relay unit 3, FIG. 14 only illustrates the structure in the vicinity of the second intermediate heat exchanger 13, and the remaining devices are not shown. In FIG. 14, blank arrows indicate the flow of air, the second heat medium, and solid line arrows indicate the flow of the refrigerant. Referring to FIG. 14, the second intermediate heat exchanger 13 serves to exchange heat between air, serving as the second heat medium, and the first refrigerant, and may be a plate fin coil heat exchanger, for example. As shown in FIG. 14, the second intermediate heat exchanger 13 is divided into a second intermediate heat exchanger 13(1) and a second intermediate heat exchanger 13(2), which are connected to each other via the refrigerant pipe. The pipe is arranged such that, when the second intermediate heat exchanger 13 acts as a condenser (cooling-only operation mode, cooling-main operation mode), the first refrigerant first flows in the second intermediate heat exchanger 13(1) and then flows in the second intermediate heat exchanger 13(2). The second intermediate heat exchanger 13(1) is provided with a fan 40 for causing ambient air to flow. In addition, a first partition plate 41 is provided between the second intermediate heat exchanger 13(1) and the second intermediate heat exchanger 13(2). On the right of the second intermediate heat exchanger 13 in FIG. 14, a second partition plate 42 is provided. The first partition plate 41 is formed so as to allow air, the second heat medium, to pass through both of the second intermediate heat exchanger 13(1) and the second intermediate heat exchanger 13(2). The second partition plate 42 serves to prevent air (second heat medium) introduced from the left of the second partition plate 42 in FIG. 14 from flowing to the right beyond the second partition plate 42. Thus, the first partition plate 41 and the second partition plate 42 define the path of the air serving as the second heat medium in the relay unit 3. Owing to the fan 40, the first partition plate 41, and the second partition plate 42, the air serving as the second heat medium is introduced into the relay unit 3 from the outer space 6, and flows along the partition plate 41 to pass through the second intermediate heat exchanger 13(2), and then flows along the partition plate 42 to reach the second intermediate heat exchanger 13(1). After passing through the second intermediate heat exchanger 13(1) along the partition plate 41, the air flows out of the relay unit 3 into the outer space 6, through the fan 40. Because of the path thus formed, the air serving as the second heat medium can be caused to flow through the second intermediate heat exchanger 13 when the relay unit 3 is installed in a space adjacent to the space inside the building 9, such as a recess formed in the wall of the building 9, and thus the heat exchange can be performed between the air serving as the second heat medium and the first refrigerant.

Figure 15:
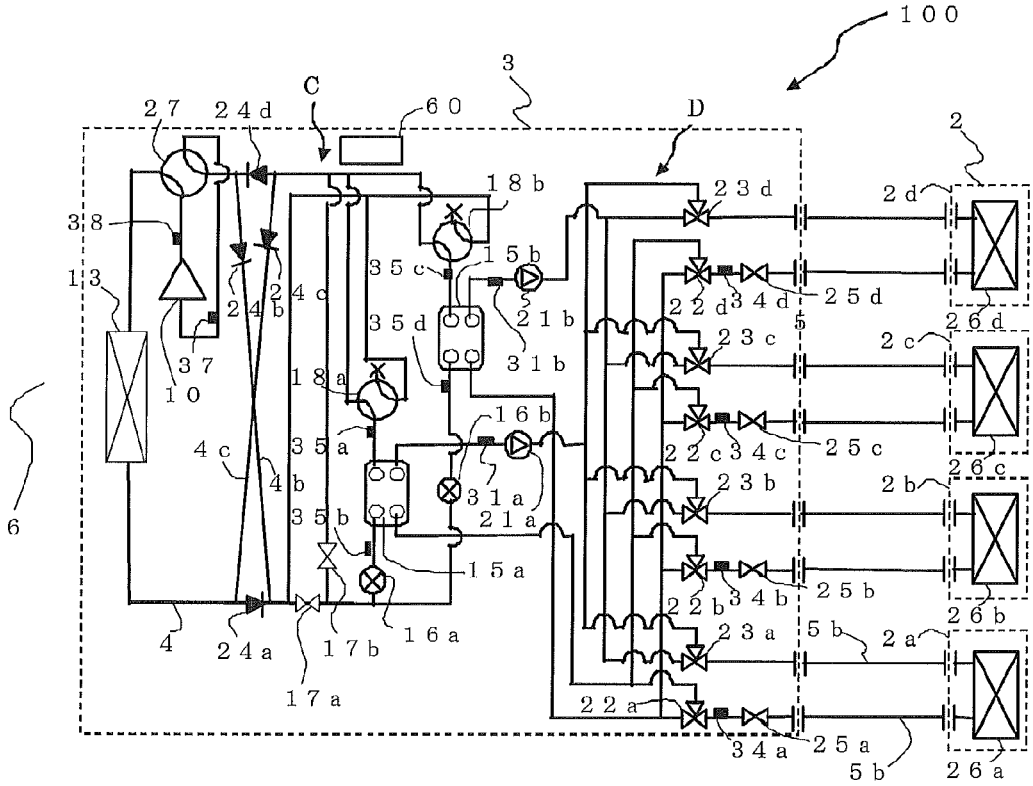
FIG. 15 is a schematic diagram showing a configuration of the air-conditioning apparatus according to Embodiment 3 of the present invention.

FIG. 15 is a schematic diagram showing a configuration of the air-conditioning apparatus according to Embodiment 3 of the present invention. The second intermediate heat exchanger 13 of Embodiment 1 shown in FIG. 2, which exchanges heat between water or brine and the first refrigerant, is substituted with the second intermediate heat exchanger 13 configured to exchange heat between air and the first refrigerant. In addition, the second heat medium circuit B and the accompanying sensors, valves, and pipes illustrated in FIG. 2 are excluded. Further, the air-conditioning apparatus according to Embodiment 3 is without the outdoor unit 1 shown in FIG. 2, which exchanges heat between the second heat medium and air in the outer space 6, because the first refrigerant and air in the outer space 6 directly exchanges heat in the second intermediate heat exchanger 13. The circulation of the first heat medium and the first refrigerant, as well as details of the operation modes, are the same as those of Embodiment 1 except that the air is utilized as the second heat medium instead of water and the like, and therefore the description will not be repeated. In addition, although the circulation of the second heat medium such as water according to Embodiment 1 is substituted with the circulation of air serving as the second heat medium, the heat exchange between the first refrigerant and the second heat medium is equally performed for heat transfer or heat removal in each of the operation modes as in Embodiment 1, and the same advantageous effects can be obtained. Further, the details of the flow of the air serving as the second heat medium are as described above, and are the same irrespective of the operation mode, and therefore such description will not be repeated.

Figure 16:
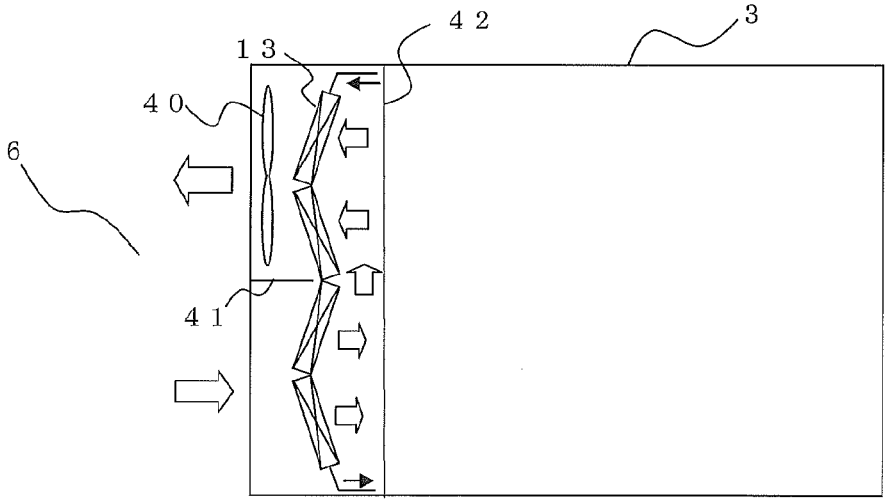
FIG. 16 is a schematic drawing showing another relay unit in the air-conditioning apparatus according to Embodiment 3 of the present invention.

FIG. 16 is a schematic drawing showing another example of the internal configuration of the relay unit 3 in the air-conditioning apparatus according to Embodiment 3 of the present invention. In the relay unit 3 shown in FIG. 14, the second intermediate heat exchanger 13 is divided into the second intermediate heat exchanger 13(1) and the second intermediate heat exchanger 13(2), which are connected to each other via the refrigerant pipe. However, different configurations may be adopted. For example, the second intermediate heat exchanger 13 may be divided into a desired number of parts. Further, the second intermediate heat exchanger 13 may be formed in a desired shape, for example in a W-shape as illustrated in FIG. 16.

FIG. 14 illustrates the case where the air serving as the second heat medium is introduced from the left side, and then turns back so as to flow out to the same side. However, in the case where the relay unit 3 is installed in the space 8 and a gap of a sufficient size is available around the relay unit 3, the relay unit 3 may be configured so as to introduce and discharge air through different sides. In such a case also, the air flows out to the outer space 6 along the periphery of the relay unit 3. Any desired configuration may be adopted, provided that the air serving as the second heat medium introduced into the relay unit 3 from the outer space 6 can again flow out to the outer space 6.

In the configuration of Embodiment 3, it is preferable to provide, in the case where the second intermediate heat exchanger 13 has a large inner volume, an accumulator on the suction side of the compressor 10, to store a surplus of the refrigerant generated from changes in the operation modes. However, for example when a heat exchanger composed of fine pipes such as flat tubes is employed as the second intermediate heat exchanger 13, the accumulator may be excluded. In either case, the present invention provides the same advantageous effects.

In addition, the relay unit 3 may be installed outside the building 9, provided that the location of the relay unit 3 is in the vicinity of the building 9, for example a location adjacent to the building 9.

REFERENCE SIGNS LIST

1: outdoor unit, 2: indoor unit, 2*a*, 2*b*, 2*c*, 2*d*: indoor unit, 3, 3*a*, 3*b*: relay unit, 4, 4*b*, 4*c*: refrigerant pipe, 5*a*: heat medium pipe for second heat medium, 5*b*: heat medium pipe for first heat medium, 6: outdoor space, 7: indoor space (space to be air-conditioned), 8: space not to be air-conditioned, 9: building, 10: compressor, 12: outdoor-side heat exchanger, 13: second intermediate heat exchanger, 14: bypass flow control device (heat source-side), 15*a*, 15*b*: first intermediate heat exchanger, 16*a*, 16*b*: first expansion device, 17*a*, 17*b*: open/close device, 18*a*, 18*b*: second refrigerant flow switching device, 20*a*, 20*b*: bypass flow control device (relay unit side), 21*a*, 21*b*: pump (first heat medium feeding device), 21*c*: pump (second heat medium feeding device), 22*a*, 22*b*, 22*c*, 22*d*: first heat medium flow switching device, 23*a*, 23*b*, 23*c*, 23*d*: second heat medium flow switching device, 24*a*, 24*b*, 24*c*, 24*d*: check valve, 25*a*, 25*b*, 25*c*, 25*d*: first heat medium flow control device, 26*a*, 26*b*, 26*c*, 26*d*: use-side heat exchanger, 27, 27*a*, 27*b*: first refrigerant flow switching device, 28: second heat medium flow control device, 29: third heat medium flow switching device, 31*a*, 31*b*: intermediate heat exchanger outlet temperature sensor, 32*a*, 32*b*: outdoor-side heat exchanger temperature sensor, 33*a*, 33*b*: intermediate heat exchanger temperature sensor, 34*a*, 34*b*, 34*c*, 34*d*: use-side heat exchanger outlet temperature sensor, 35*a*, 35*b*, 35*c*, 35*d*: intermediate heat exchanger refrigerant temperature sensor, 37: low-pressure refrigerant pressure sensor, 38: high-pressure refrigerant pressure sensor, 40: fan (for second intermediate heat exchanger 13), 41: first partition plate, 42: second partition plate, 50: controller (outdoor unit), 60: controller (relay unit), 100: air-conditioning apparatus, B: second heat medium circuit, C: first refrigerant circuit, D: first heat medium circuit

The invention claimed is:

1. An air-conditioning apparatus comprising:

a plurality of indoor units each located inside a building and at a position that allows the indoor unit to condition air in a space to be air-conditioned;

a relay unit configured to be installed in a space not to be air-conditioned separated from the space to be air-conditioned, the space not to be air-conditioned being one of a space inside the building, and a space outside and close to the building; and a second heat medium circuit including a pair of second heat medium pipes for supplying the second heat medium, the pair of second heat medium pipes connecting the space outside of the building and the relay unit, wherein the relay unit and each of the indoor units are connected to each other via a first heat medium pipe in which a first heat medium flows, the first heat medium being one of water and brine, the relay unit accommodates therein a refrigerant circuit including a compressor, a plurality of first intermediate heat exchangers that exchange heat between the first heat medium and refrigerant that performs a phase shift or turns to a supercritical state during operation, a plurality of expansion devices, and a second intermediate heat exchanger that exchanges heat between the refrigerant and a second heat medium being one of water and brine, the compressor, the plurality of first intermediate heat exchangers, the expansion devices, and the second intermediate heat exchanger being connected via a refrigerant pipe, and is configured to cool the first heat medium and heat the first heat medium simultaneously, separately transport the cooled first heat medium and the heated first heat medium to the plurality of indoor units, and cause the second heat medium to circulate between the outside of the building and the relay unit and exchange heat with the refrigerant in the second intermediate heat exchanger, wherein the refrigerant transfers heat to or removes heat from air in an outdoor space outside the building via the second heat medium, through heat exchange between the refrigerant and the second heat medium performed in the second intermediate heat exchanger.

2. The air-conditioning apparatus of claim 1, wherein the refrigerant circuit further includes a first refrigerant flow switching device and second refrigerant flow switching devices, a heat medium-side flow path in each of the plurality of first intermediate heat exchangers, a plurality of first heat medium feeding devices that deliver the first heat medium, a plurality of use-side heat exchangers that exchange heat between air in the space to be air-conditioned and the first heat medium, and a plurality of first heat medium flow switching devices provided on a heat medium inlet side and outlet side of the plurality of use-side heat exchangers and configured to switch a flow path of the first heat medium constitute a first heat medium circuit by being connected via the first heat medium pipe, the indoor units each accommodate therein one of the use-side heat exchangers, and the relay unit removes heat from or transfers heat to the second heat medium with evaporation heat or condensation heat of the refrigerant, and cools the first heat medium in one or more of the plurality of first intermediate heat exchangers and heat the first heat medium in the remaining first intermediate heat exchangers simultaneously, with the evaporation heat or the condensation heat of the refrigerant.

3. The air-conditioning apparatus of claim 1, further comprising a heat removal and heat transfer unit configure to cause the second heat medium to remove heat from or transfer heat to the air in the outdoor space.

4. The air-conditioning apparatus of claim 3, wherein the heat removal and heat transfer unit is an outdoor unit configured to control a temperature of the second heat medium.

5. The air-conditioning apparatus of claim 4, wherein the second heat medium circuit further includes an outdoor-side heat exchanger that exchanges heat between outside air and the second heat medium, and a second heat medium feeding device, the outdoor-side heat exchanger and the second heat medium feeding device are accommodated in the outdoor unit, and the outdoor unit is installed in the outdoor space outside the building or in a space inside the building and communicating with the outdoor space.

6. The air-conditioning apparatus claim 1, wherein the second heat medium circuit further includes a second heat medium flow control device that variably adjusts an opening degree thereof, and a flow rate of the second heat medium passing through the second intermediate heat exchanger is adjusted by controlling the opening degree of the second heat medium flow control device.

7. The air-conditioning apparatus of claim 6, further comprising:

a first controller provided inside or close to the relay unit; and a second controller provided inside or close to an outdoor unit, wherein the second controller is controllably connected to the second heat medium feeding device, and the first controller and the second controller are connected to each other via a wired or wireless signal line to allow transmission and reception of a signal, and a linkage control of the opening degree of the second heat medium flow control device and a rotation speed of the second heat medium feeding device is performed based on transmission and reception of information including at least the opening degree of the second heat medium flow control device, between the first controller and the second controller.

8. The air-conditioning apparatus of claim 5, further comprising:

a first heat medium temperature sensor provided at least one of an inlet side and an outlet side of a heat medium-side flow path in the second intermediate heat exchanger;

a first controller provided inside or close to the relay unit; and a second controller provided inside or close to the outdoor unit, wherein the second controller is controllably connected to the second heat medium feeding device, and the first controller and the second controller are connected to each other via a wired or wireless signal line to allow transmission and reception of a signal, and a rotation speed of the second heat medium feeding device is controlled based on transmission and reception of a temperature detected by the first heat medium temperature sensor or a value calculated from the temperature detected by the first heat medium temperature sensor, between the first controller and the second controller.

9. The air-conditioning apparatus claim 1, wherein the refrigerant is low-flammable refrigerant having a burning rate equal to or lower than 10 cm/s and a global warming potential equal to or lower than 50.

10. The air-conditioning apparatus claim 1, wherein the refrigerant of an amount equal to or less than 1.8 kg is loaded in the refrigerant circuit in the case where the refrigerant is R-32, and the refrigerant of an amount equal to or less than 1.7 kg is loaded in the refrigerant circuit in the case where the refrigerant is HFO-1234yf.

* * * * *